US009142206B2

(12) United States Patent
O'Dell

(10) Patent No.: US 9,142,206 B2
(45) Date of Patent: Sep. 22, 2015

(54) SYSTEM FOR INTERCHANGEABLE MOUNTING OPTIONS FOR A SONAR TRANSDUCER

(75) Inventor: Kyle D. O'Dell, Fort Gibson, OK (US)

(73) Assignee: Navico Holding AS, Egersund (NO)

( * ) Notice: Subject to any disclaimer, the term of this patent is extended or adjusted under 35 U.S.C. 154(b) by 758 days.

(21) Appl. No.: 13/183,034

(22) Filed: Jul. 14, 2011

(65) Prior Publication Data

US 2013/0016588 A1 Jan. 17, 2013

(51) Int. Cl.
*G10K 11/00* (2006.01)

(52) U.S. Cl.
CPC ..... *G10K 11/006* (2013.01)

(58) Field of Classification Search
CPC ..... G01K 11/006
USPC ..... 248/205.5
See application file for complete search history.

(56) References Cited

U.S. PATENT DOCUMENTS

| | | | |
|---|---|---|---|
| 1,667,540 | A | 4/1928 | Dorsey |
| 1,823,329 | A | 9/1931 | Marrison |
| 2,416,338 | A | 2/1947 | Mason |
| 3,005,973 | A | 10/1961 | Kietz |
| 3,090,030 | A | 5/1963 | Schuck |
| 3,142,032 | A | 7/1964 | Jones |
| 3,144,631 | A | 8/1964 | Lustig et al. |
| 3,296,579 | A | 1/1967 | Farr et al. |
| 3,304,532 | A | 2/1967 | Nelkin et al. |
| 3,359,537 | A | 12/1967 | Geil et al. |
| 3,381,264 | A | 4/1968 | Lavergne et al. |
| 3,451,038 | A | 6/1969 | Maass |
| 3,458,854 | A | 7/1969 | Murphree |
| 3,484,737 | A | 12/1969 | Walsh |
| 3,496,524 | A | 2/1970 | Stavis et al. |
| 3,553,638 | A | 1/1971 | Sublett |

(Continued)

FOREIGN PATENT DOCUMENTS

| | | |
|---|---|---|
| DE | 1 566 870 A1 | 4/1970 |
| DE | 35 16 698 AI | 11/1986 |

(Continued)

OTHER PUBLICATIONS

International Search Report and Written Opinion for Application No. PCT/US2012/046062 dated Dec. 14, 2012.

(Continued)

*Primary Examiner* — Isam Alsomiri
*Assistant Examiner* — Hovhannes Baghdasaryan
(74) *Attorney, Agent, or Firm* — Alston & Bird LLP

(57) ABSTRACT

Systems and apparatuses for interchangeable mounting options for a transducer housing are provided herein. Such a system may provide for easy change of mounting to a watercraft, such as between transom mounting, portable mounting, trolling motor mounting, and thru-hull mounting. A system for interchangeable mounting options of a sonar transducer to a watercraft may comprise at least one transducer, a transducer housing configured to house the at least one transducer, and a mount adapter. The transducer housing may comprise at least one upper engagement surface configured to adjacently engage the mount adapter to facilitate mounting. The at least one upper engagement surface may be configured to releasably engage the mount adapter to allow the mount adapter to be detached and removed without damaging or altering the transducer housing.

18 Claims, 28 Drawing Sheets

(56) References Cited

U.S. PATENT DOCUMENTS

| | | | | |
|---|---|---|---|---|
| 3,585,578 | A | 6/1971 | Fischer, Jr. et al. | |
| 3,585,579 | A | 6/1971 | Dorr et al. | |
| 3,618,006 | A | 11/1971 | Wright | |
| 3,624,596 | A | 11/1971 | Dickenson | |
| 3,716,824 | A | 2/1973 | Dorr et al. | |
| 3,742,436 | A | 6/1973 | Jones | |
| 3,753,219 | A * | 8/1973 | King, Jr. | 367/173 |
| 3,757,287 | A | 9/1973 | Bealor, Jr. | |
| 3,781,775 | A | 12/1973 | Malloy et al. | |
| 3,895,339 | A | 7/1975 | Jones et al. | |
| 3,895,340 | A | 7/1975 | Gilmour | |
| 3,898,608 | A | 8/1975 | Jones et al. | |
| 3,907,239 | A | 9/1975 | Ehrlich | |
| 3,922,631 | A | 11/1975 | Thompson et al. | |
| 3,949,348 | A | 4/1976 | Dorr | |
| 3,950,723 | A | 4/1976 | Gilmour | |
| 3,953,828 | A | 4/1976 | Cook | |
| 3,964,424 | A | 6/1976 | Hagemann | |
| 3,967,234 | A | 6/1976 | Jones | |
| 3,975,704 | A | 8/1976 | Klein | |
| 4,030,096 | A | 6/1977 | Stevens et al. | |
| 4,047,148 | A | 9/1977 | Hagemann | |
| 4,052,693 | A | 10/1977 | Gilmour | |
| 4,063,212 | A | 12/1977 | Sublett | |
| 4,068,209 | A | 1/1978 | Lagier | |
| 4,075,599 | A | 2/1978 | Kosalos et al. | |
| 4,121,190 | A | 10/1978 | Edgerton et al. | |
| 4,184,210 | A | 1/1980 | Hagemann | |
| 4,195,702 | A | 4/1980 | Denis | |
| 4,197,591 | A | 4/1980 | Hagemann | |
| 4,198,702 | A | 4/1980 | Clifford | |
| 4,199,746 | A | 4/1980 | Jones et al. | |
| 4,200,922 | A | 4/1980 | Hagemann | |
| 4,204,281 | A | 5/1980 | Hagemann | |
| 4,207,620 | A | 6/1980 | Morgera | |
| 4,208,738 | A * | 6/1980 | Lamborn | 367/173 |
| 4,216,537 | A | 8/1980 | Delignieres | |
| 4,232,380 | A | 11/1980 | Caron et al. | |
| 4,247,923 | A | 1/1981 | De Kok | |
| 4,262,344 | A | 4/1981 | Gilmour | |
| 4,287,578 | A | 9/1981 | Heyser | |
| 4,347,591 | A | 8/1982 | Stembridge et al. | |
| RE31,026 | E | 9/1982 | Shatto | |
| 4,400,803 | A | 8/1983 | Spiess et al. | |
| 4,413,331 | A | 11/1983 | Rowe, Jr. et al. | |
| 4,422,166 | A | 12/1983 | Klein | |
| 4,456,210 | A | 6/1984 | McBride | |
| 4,493,064 | A | 1/1985 | Odero et al. | |
| 4,496,064 | A | 1/1985 | Beck et al. | |
| 4,538,249 | A | 8/1985 | Richard | |
| 4,561,076 | A | 12/1985 | Gritsch | |
| 4,596,007 | A | 6/1986 | Grall et al. | |
| 4,635,240 | A | 1/1987 | Geohegan, Jr. et al. | |
| 4,641,290 | A | 2/1987 | Massa et al. | |
| 4,642,801 | A | 2/1987 | Perny | |
| 4,751,645 | A | 6/1988 | Abrams et al. | |
| 4,774,837 | A | 10/1988 | Bird | |
| 4,796,238 | A | 1/1989 | Bourgeois et al. | |
| 4,802,148 | A | 1/1989 | Gilmour | |
| 4,815,045 | A | 3/1989 | Nakamura | |
| 4,829,493 | A | 5/1989 | Bailey | |
| 4,855,961 | A | 8/1989 | Jaffe et al. | |
| 4,879,697 | A | 11/1989 | Lowrance et al. | |
| 4,907,208 | A | 3/1990 | Lowrance et al. | |
| 4,912,685 | A | 3/1990 | Gilmour | |
| 4,924,448 | A | 5/1990 | Gaer | |
| 4,935,906 | A | 6/1990 | Baker et al. | |
| 4,939,700 | A | 7/1990 | Breton | |
| 4,958,330 | A | 9/1990 | Higgins | |
| 4,970,700 | A | 11/1990 | Gilmour et al. | |
| 4,972,387 | A | 11/1990 | Warner | |
| 4,975,887 | A | 12/1990 | Maccabee et al. | |
| 4,982,924 | A | 1/1991 | Havins | |
| 5,025,423 | A | 6/1991 | Earp | |
| 5,033,029 | A | 7/1991 | Jones | |
| 5,077,699 | A | 12/1991 | Passamante et al. | |
| 5,109,364 | A | 4/1992 | Stiner | |
| 5,113,377 | A | 5/1992 | Johnson | |
| 5,142,497 | A | 8/1992 | Warrow | |
| 5,142,502 | A | 8/1992 | Wilcox et al. | |
| D329,615 | S | 9/1992 | Stiner | |
| D329,616 | S | 9/1992 | Stiner | |
| 5,155,706 | A | 10/1992 | Haley et al. | |
| 5,182,732 | A | 1/1993 | Pichowkin | |
| 5,184,330 | A | 2/1993 | Adams et al. | |
| 5,191,341 | A | 3/1993 | Gouard et al. | |
| 5,200,931 | A | 4/1993 | Kosalos et al. | |
| 5,214,744 | A | 5/1993 | Schweizer et al. | |
| 5,231,609 | A | 7/1993 | Gaer | |
| 5,237,541 | A | 8/1993 | Woodsum | |
| 5,241,314 | A | 8/1993 | Keeler et al. | |
| 5,243,567 | A | 9/1993 | Gingerich | |
| 5,245,587 | A | 9/1993 | Hutson | |
| 5,257,241 | A | 10/1993 | Henderson et al. | |
| 5,260,912 | A | 11/1993 | Latham | |
| 5,297,109 | A | 3/1994 | Barksdale, Jr. et al. | |
| 5,299,173 | A | 3/1994 | Ingram | |
| 5,303,208 | A | 4/1994 | Dorr | |
| 5,376,933 | A | 12/1994 | Tupper et al. | |
| 5,390,152 | A | 2/1995 | Boucher et al. | |
| 5,412,618 | A | 5/1995 | Gilmour | |
| 5,433,202 | A | 7/1995 | Mitchell et al. | |
| 5,438,552 | A | 8/1995 | Audi et al. | |
| 5,442,358 | A | 8/1995 | Keeler et al. | |
| 5,455,806 | A | 10/1995 | Hutson | |
| 5,485,432 | A | 1/1996 | Aechter et al. | |
| 5,493,619 | A | 2/1996 | Haley et al. | |
| 5,515,337 | A | 5/1996 | Gilmour et al. | |
| 5,525,081 | A | 6/1996 | Mardesich et al. | |
| 5,526,765 | A * | 6/1996 | Ahearn | 114/343 |
| 5,537,366 | A | 7/1996 | Gilmour | |
| 5,537,380 | A | 7/1996 | Sprankle, Jr. et al. | |
| 5,546,356 | A | 8/1996 | Zehner | |
| 5,546,362 | A | 8/1996 | Baumann et al. | |
| 5,561,641 | A | 10/1996 | Nishimori et al. | |
| 5,574,700 | A | 11/1996 | Chapman | |
| 5,596,549 | A | 1/1997 | Sheriff | |
| 5,596,550 | A | 1/1997 | Rowe, Jr. et al. | |
| 5,602,801 | A | 2/1997 | Nussbaum et al. | |
| 5,612,928 | A | 3/1997 | Haley et al. | |
| 5,623,524 | A | 4/1997 | Weiss et al. | |
| 5,675,552 | A | 10/1997 | Hicks et al. | |
| 5,694,372 | A | 12/1997 | Perennes | |
| 5,790,474 | A | 8/1998 | Feintuch | |
| 5,805,525 | A | 9/1998 | Sabol et al. | |
| 5,805,528 | A | 9/1998 | Hamada et al. | |
| 5,808,967 | A | 9/1998 | Yu et al. | |
| 5,838,635 | A | 11/1998 | Masreliez | |
| 5,850,372 | A | 12/1998 | Blue | |
| 5,930,199 | A | 7/1999 | Wilk | |
| 5,991,239 | A | 11/1999 | Fatemi-Booshehri et al. | |
| 6,002,644 | A | 12/1999 | Wilk | |
| 6,084,827 | A | 7/2000 | Johnson et al. | |
| 6,130,641 | A | 10/2000 | Kraeutner et al. | |
| 6,215,730 | B1 | 4/2001 | Pinto | |
| 6,225,984 | B1 | 5/2001 | Crawford | |
| 6,226,227 | B1 | 5/2001 | Lent et al. | |
| 6,273,771 | B1 | 8/2001 | Buckley et al. | |
| 6,285,628 | B1 | 9/2001 | Kiesel | |
| 6,321,158 | B1 | 11/2001 | DeLorme et al. | |
| 6,325,020 | B1 | 12/2001 | Guigne et al. | |
| 6,335,905 | B1 | 1/2002 | Kabel | |
| 6,411,283 | B1 | 6/2002 | Murphy | |
| 6,418,080 | B2 | 7/2002 | Inouchi | |
| 6,421,299 | B1 | 7/2002 | Betts et al. | |
| 6,421,301 | B1 | 7/2002 | Scanlon | |
| 6,445,646 | B1 | 9/2002 | Handa et al. | |
| 6,449,215 | B1 | 9/2002 | Shell | |
| 6,537,224 | B2 | 3/2003 | Mauchamp et al. | |
| 6,606,958 | B1 | 8/2003 | Bouyoucos | |
| 6,678,403 | B1 | 1/2004 | Wilk | |
| 6,738,311 | B1 | 5/2004 | Guigne | |
| 6,761,692 | B2 | 7/2004 | Angelsen et al. | |
| 6,778,468 | B1 | 8/2004 | Nishimori et al. | |

(56) References Cited

U.S. PATENT DOCUMENTS

| | | | | |
|---|---|---|---|---|
| 6,816,782 | B1 | 11/2004 | Walters et al. | |
| 6,842,401 | B2 | 1/2005 | Chiang et al. | |
| 6,899,574 | B1 | 5/2005 | Kalis et al. | |
| 6,904,798 | B2 | 6/2005 | Boucher et al. | |
| 6,941,226 | B2 | 9/2005 | Estep | |
| 6,980,688 | B2 | 12/2005 | Wilk | |
| 7,002,579 | B2 | 2/2006 | Olson | |
| 7,035,166 | B2 | 4/2006 | Zimmerman et al. | |
| 7,036,451 | B1 * | 5/2006 | Hutchinson | 114/364 |
| 7,215,599 | B2 | 5/2007 | Nishimori et al. | |
| 7,236,426 | B2 | 6/2007 | Turner et al. | |
| 7,236,427 | B1 | 6/2007 | Schroeder | |
| 7,239,263 | B1 | 7/2007 | Sawa | |
| 7,242,638 | B2 | 7/2007 | Kerfoot et al. | |
| 7,305,929 | B2 * | 12/2007 | MacDonald et al. | 114/173 |
| 7,339,494 | B2 | 3/2008 | Shah et al. | |
| 7,355,924 | B2 | 4/2008 | Zimmerman et al. | |
| 7,369,459 | B2 | 5/2008 | Kawabata et al. | |
| 7,405,999 | B2 | 7/2008 | Skjold-Larsen | |
| 7,430,461 | B1 | 9/2008 | Michaels | |
| 7,542,376 | B1 | 6/2009 | Thompson et al. | |
| 7,652,952 | B2 | 1/2010 | Betts et al. | |
| 7,710,825 | B2 | 5/2010 | Betts et al. | |
| 7,729,203 | B2 | 6/2010 | Betts et al. | |
| 7,755,974 | B2 | 7/2010 | Betts et al. | |
| 7,812,667 | B2 | 10/2010 | Fagg | |
| 7,839,720 | B2 | 11/2010 | Brumley et al. | |
| 7,870,496 | B1 | 1/2011 | Sherwani | |
| 7,889,600 | B2 | 2/2011 | Thompson et al. | |
| 7,890,867 | B1 | 2/2011 | Margulis | |
| 7,961,552 | B2 | 6/2011 | Boucher et al. | |
| 8,019,532 | B2 | 9/2011 | Sheha et al. | |
| 8,063,540 | B2 | 11/2011 | Angelsen et al. | |
| 8,300,499 | B2 | 10/2012 | Coleman et al. | |
| 8,305,840 | B2 | 11/2012 | Maguire | |
| 8,305,841 | B2 | 11/2012 | Riordan et al. | |
| 8,514,658 | B2 | 8/2013 | Maguire | |
| 8,605,550 | B2 | 12/2013 | Maguire | |
| 2001/0026499 | A1 | 10/2001 | Inouchi | |
| 2002/0035574 | A1 | 3/2002 | Dumas | |
| 2002/0071029 | A1 | 6/2002 | Zell et al. | |
| 2002/0085452 | A1 | 7/2002 | Scanlon | |
| 2002/0093541 | A1 | 7/2002 | Schileru-Key | |
| 2002/0126577 | A1 | 9/2002 | Borchardt | |
| 2003/0202426 | A1 | 10/2003 | Ishihara et al. | |
| 2003/0206489 | A1 | 11/2003 | Preston et al. | |
| 2003/0214880 | A1 | 11/2003 | Rowe | |
| 2004/0184351 | A1 | 9/2004 | Nishimori et al. | |
| 2004/0193364 | A1 | 9/2004 | Chojnacki | |
| 2004/0221468 | A1 | 11/2004 | Cotterchio et al. | |
| 2005/0036404 | A1 | 2/2005 | Zhu et al. | |
| 2005/0043619 | A1 | 2/2005 | Sumanaweera et al. | |
| 2005/0099887 | A1 | 5/2005 | Zimmerman et al. | |
| 2005/0102101 | A1 | 5/2005 | Beesley et al. | |
| 2005/0216487 | A1 | 9/2005 | Fisher et al. | |
| 2006/0002232 | A1 | 1/2006 | Shah et al. | |
| 2006/0013066 | A1 | 1/2006 | Nishimori et al. | |
| 2006/0023570 | A1 * | 2/2006 | Betts et al. | 367/88 |
| 2006/0119585 | A1 | 6/2006 | Skinner | |
| 2006/0224940 | A1 | 10/2006 | Lee | |
| 2007/0025183 | A1 | 2/2007 | Zimmerman et al. | |
| 2007/0091723 | A1 | 4/2007 | Zhu et al. | |
| 2007/0159922 | A1 | 7/2007 | Zimmerman et al. | |
| 2008/0013404 | A1 | 1/2008 | Acker et al. | |
| 2008/0126935 | A1 | 5/2008 | Blomgren | |
| 2008/0137483 | A1 | 6/2008 | Sawrie | |
| 2008/0204424 | A1 | 8/2008 | Jin et al. | |
| 2009/0031940 | A1 | 2/2009 | Stone et al. | |
| 2009/0064055 | A1 | 3/2009 | Chaudhri et al. | |
| 2009/0099871 | A1 | 4/2009 | Gadodia | |
| 2009/0179789 | A1 | 7/2009 | Haughay, Jr. et al. | |
| 2009/0249247 | A1 | 10/2009 | Tseng et al. | |
| 2009/0287409 | A1 | 11/2009 | Summers | |
| 2010/0054084 | A1 * | 3/2010 | Boucher et al. | 367/118 |
| 2010/0080082 | A1 | 4/2010 | Betts et al. | |
| 2010/0145601 | A1 | 6/2010 | Kurtti et al. | |
| 2010/0199225 | A1 | 8/2010 | Coleman et al. | |
| 2010/0226203 | A1 | 9/2010 | Buttle et al. | |
| 2010/0250122 | A1 | 9/2010 | Kubota et al. | |
| 2010/0277379 | A1 * | 11/2010 | Lindackers et al. | 343/713 |
| 2011/0007606 | A1 | 1/2011 | Curtis | |
| 2011/0012773 | A1 | 1/2011 | Cunning et al. | |
| 2011/0013484 | A1 * | 1/2011 | Coleman et al. | 367/88 |
| 2011/0013485 | A1 | 1/2011 | Maguire | |
| 2011/0019887 | A1 | 1/2011 | Roehrig et al. | |
| 2011/0025720 | A1 | 2/2011 | Jo et al. | |
| 2011/0154183 | A1 | 6/2011 | Burns et al. | |
| 2011/0238762 | A1 | 9/2011 | Soni et al. | |
| 2012/0001773 | A1 | 1/2012 | Lyons et al. | |
| 2012/0011437 | A1 | 1/2012 | James et al. | |
| 2012/0014220 | A1 | 1/2012 | Depasqua | |
| 2012/0069712 | A1 | 3/2012 | Potanin et al. | |
| 2012/0106300 | A1 | 5/2012 | Maguire | |
| 2012/0185801 | A1 | 7/2012 | Madonna et al. | |
| 2013/0007665 | A1 | 1/2013 | Chaudhri et al. | |
| 2013/0148471 | A1 | 6/2013 | Brown et al. | |
| 2013/0208568 | A1 | 8/2013 | Coleman | |
| 2014/0010048 | A1 | 1/2014 | Proctor | |
| 2014/0064024 | A1 | 3/2014 | Maguire | |

FOREIGN PATENT DOCUMENTS

| | | | |
|---|---|---|---|
| EP | 1 272 870 | B1 | 4/2004 |
| EP | 1 393 025 | B1 | 2/2006 |
| EP | 2 070 068 | B1 | 3/2008 |
| EP | 2 023 159 | A1 | 2/2009 |
| GB | 823304 | A | 11/1959 |
| GB | 1 306 769 | A | 2/1973 |
| GB | 1 315 651 | A | 5/1973 |
| GB | 1316138 | | 5/1973 |
| GB | 1 329 829 | A | 9/1973 |
| GB | 1 330 472 | A | 9/1973 |
| GB | 2 111 679 | A | 7/1983 |
| GB | 2 421 312 | A | 6/2006 |
| GB | 2 444 161 | A | 5/2008 |
| JP | 50-109389 | U | 9/1975 |
| JP | 54-054365 | U | 4/1979 |
| JP | 57-046173 | A | 3/1982 |
| JP | 58-079178 | A | 5/1983 |
| JP | S-59-107285 | A | 6/1984 |
| JP | S-61-102574 | A | 5/1986 |
| JP | 61-116678 | A | 6/1986 |
| JP | S-61-262674 | A | 11/1986 |
| JP | 62-099877 | U | 6/1987 |
| JP | 62-134084 | U | 8/1987 |
| JP | 62-190480 | A | 8/1987 |
| JP | 63-261181 | A | 10/1988 |
| JP | H02-159591 | A | 6/1990 |
| JP | H-03-85476 | A | 4/1991 |
| JP | 4-357487 | A | 12/1992 |
| JP | 4357487 | A | 12/1992 |
| JP | 7-031042 | A | 1/1995 |
| JP | 07-270523 | A | 10/1995 |
| JP | A-10-132930 | A | 5/1998 |
| JP | H-10-123247 | A | 5/1998 |
| JP | 10-186030 | A | 7/1998 |
| JP | H-10-325871 | A | 12/1998 |
| JP | 2001-074840 | A | 3/2001 |
| JP | 2002-168592 | A | 6/2002 |
| JP | 2004-020276 | A | 1/2004 |
| JP | 2004-219400 | A | 8/2004 |
| JP | 2005-091307 | A | 4/2005 |
| JP | 2006-064524 | A | 3/2006 |
| JP | 2006-162480 | A | 6/2006 |
| JP | 2006-208300 | A | 8/2006 |
| JP | 2008-508539 | | 3/2008 |
| JP | 2008-128900 | A | 6/2008 |
| JP | 2009-222414 | A | 10/2009 |
| JP | 2010-030340 | A | 2/2010 |
| WO | WO 84/01833 | A1 | 5/1984 |
| WO | WO-91/02989 | A1 | 3/1991 |
| WO | WO 98/15846 | | 4/1998 |
| WO | WO 03/009276 | A2 | 1/2003 |
| WO | WO-2005/057234 | A1 | 6/2005 |

(56) References Cited

FOREIGN PATENT DOCUMENTS

| | | | |
|---|---|---|---|
| WO | WO-2008/105932 | A2 | 9/2008 |
| WO | WO-2008/152618 | A1 | 12/2008 |
| WO | WO 2011/008429 | A1 | 1/2011 |

OTHER PUBLICATIONS

Anderson, K.; "Side-Scanning for Sport Fishing"; Salt Water Sportsman; Apr. 1, 2009; 4 pages.
Armstrong, A.A., et al.; "New Technology for Shallow Water Hydrographic Surveys"; Proceedings of the 25th Joint Meeting of UJNR Sea-bottom Surveys Panel; Dec. 1996.
Baker, N., et al, "Rifting History of the Northern Mariana Trough: SeaMARCH II and Seismic Reflection Surveys," Journals of Geophysical Research, vol. 101, No. B5, May 10, 1996.
Ballantyne, J.; "Find and Catch More Fish, Quickly and Easily, with the Fishin' Buddy 2255"; [Online]; [Retrieved on Dec. 7, 2011]; Retrieved from the Internet <URL:http://www.articleslash.net/Recreation-and-Sports/Fishing/67018_Find-and-Catch-More-Fish-Quickly-and-Easily-with-the-FISHIN-BUDDY-2255.html>; 4 pages.
Cowie, P.A., et al., "Quantitative Fault Studies on the East Pacific Rise: A Comparison of Sonar Imaging Techniques," Journal of Geophysical Research, vol. 99, B8, Aug. 10, 1994.
Farrell, E.J.; , "Color Display and Interactive Interpretation of Three-Dimensional Data"; IBM Journal of Research and Development; vol. 27; No. 4; Jul. 1983; pp. 356-366.
Hansen, H.H.; "Circular vs. rectangular transducers"; Department of Electronics and Telecommunications; Norwegian University of Science and Technolgy; Mar. 2010; 28 pages.
Hughes Clarke, J.E.; "Seafloor characterization using keel-mounted sidescan: proper compensation for radiometric and geometric distortion"; Canadian Hydrographic Conference; May 2004; 18 pages.
Hussong, D.M., et al., "High-Resolution Acoustic Seafloor Mapping," 20th Annual OTC, Houston, TX, May 2-5, 1988.
Key, W.H.; "Side Scan Sonar Technology"; Oceans 2000 MTS/IEEE Conference and Exhibition; vol. 2; Sep. 2000; pp. 1029-1033.
Kielczynski, P., et al.; "Finite Element Method (FEM) and Impulse Response Method (IRM) analysis of circular and rectangular transducers"; 1995 IEEE Ultrasonics Symposium; 1995; pp. 693-696.
Kozak, G.; "Side Scan Sonar Target Comparative Techniques for Port Security and MCM Q-Route Requirements"; L-3 Communications; Klein Associates, Inc.; [Online]; Retrieved from the Internet <URL: http://www.chesapeaketech.com/techniques-port-security.pdf; 11 pages.
Krotser, D.J., et al.; "Side-Scan Sonar: Selective Textural Enhancement"; Oceans'76; Washington, DC; Sep. 1976.
Langeraar, W.; "Surveying and Charting of the Seas"; Elsevier Oceanography Series; vol. 37; Sep. 1983; p. 321.
Manley, J.E., et al.; "Evolution of the Autonomous Surface Craft 'AutoCar'"; Oceans 2000 MTS/IEEE Conference and Exhibition; vol. 1; Sep. 2000; pp. 403-408.
Melvin, G., et al.; Commercial fishing vessels, automatic acoustic logging systems and 3D data visualization; ICES; Journal of Marine Science; vol. 59; Issue 1; 2002; pp. 179-189.
Newman, P.M.; "MOOS-Mission Orientated Operating Suite"; Department of Ocean Engineering; Massachusetts Institute of Technology; 2002.
Ollivier, F., et al.; "Side scan sonar using phased arrays for high resolution imaging and wide swath bathymetry"; IEEE Proceedings on Radar, Sonar and Navigation; vol. 143; Issue 3; Jun. 1996; pp. 163-168.
Prickett, T.; "Underwater Inspection of Coastal Structures"; The REMR Bulletin; vol. 14; No. 2; Aug. 1997.
Pratson, L.F., et al.; "Introduction to advances in seafloor mapping using sidescan sonar and multibeam bathymetry data"; Marine Geophysical Research; Springer Netherlands; vol. 18; Issue 6; 1996; pp. 601-605.
Trevorrow, M.V., et al.; "Description and Evaluation of a Four-Channel, Coherent 100-kHz Sidescan Sonar"; Defence R&D Canada-Atlantic; Dec. 2004.
Vaganay, J., et al.; "Experimental validation of the Moving Long Base-Line Navigation Concept"; 2004 IEEE/OES Autonomous Underwater Vehicles; Jun. 2004.
Vaneck, T.W., et al.; "Automated Bathymetry Using an Autonomous Surface Craft"; Journal of the Institute of Navigation; vol. 43; Issue 4; Winter 1996; pp. 329-334.
Waite, A.D.; "Sonar for Practising Engineers"; Third Edition; John Wiley & Sons, Ltd.; West Sussex, England; © 2002; 323 pages.
Alpine Geophysical Data Programmer Model 485C Brochure and letter dated Feb. 17, 1976; 2 pages.
Deep Vision Side Scan Sonar Systems; [Online]; [Retrieved on Dec. 2, 2011]; Retrieved from the Internet <URL:http://www.deepvision.se/products.htm>; 5 pages.
Detailed Sonar Transducer Product Information; Transducer Products; Side Scans; Models T36, T63, T62, and T403; Dec. 30, 2003; Retrieved from internet: URL:http://www.neptune-sonar.com/products.as_btype=Side-Scan+Transducers&category=; 4 pages.
EDO Corporation Global Technology Reach, Model 6400 Fan Beam Transducer; http:/web/archive/org/web/20040608054923/www.edoceramic.con/NavDucers.htm; Jun. 3, 2004.
File Wrapper of Provisional Application U.S. Appl. No. 60/552,769, filed Mar. 12, 2004; Applicant: Terrence Schoreder.
Fishin' Buddy 4200™ Operations Manual; Dated Dec. 21, 2005; 16 pages.
FishFinder L265 Instruction Manual; Raymarine; 79 pages.
FishFinder L365 Instruction Manual; Raymarine; 83 pages.
FishFinder L750 Instruction Manual; Raymarine; 93 pages.
Fishing Tool Reviews—Bottom Line Fishin Buddy 1200 Fishfinder; [Online]; [Retrieved on Dec. 7, 2011]; Retrieved from the Internet.
GlobalMap Sport; Installation and Operation Instructions; Lowrance Electronics, Inc.; ©1996; 61 pages.
Humminbird 100 Series™ Fishin' Buddy®; 110, 120, 130 and 140c Product Manual; © 2007; 2 pages.
Humminbird 1197c Operations Manual; Nov. 6, 2007; 196 pages.
Humminbird 200DX Dual Beam Operations Manual; 43 pages.
Humminbird 500 Series; 550, 560, 570 and 570 DI Operations Manual; © 2010; 84 pages.
Humminbird: America's favorite Fishfinder—the leading innovator of Side Imaging technology; [Online]; [Retrieved on Mar. 16, 2011]; Retrieved from the Internet <URL:http://www.humminbird.com/support/ProductManuals.aspx>; 20 pages.
Humminbird Dimension 3 Sonar 600 Operations Manual; 24 pages.
The Humminbird GPS Navigational System. Nothing Else Even Close.; Humminbird Marine Information Systems ®; 1992; 10 pages.
Humminbird GPS NS 10 Operations Manual; 75 pages.
Humminbird High Speed Transducer; 4 pages.
Humminbird Lcr 400 ID Operations Manual; 28 pages.
Humminbird Marine Information Systems; Dimension 3 Sonar™; 1992; 16 pages.
Humminbird "Matrix 35 Fishing System," Prior to Aug. 2, 2003.
Humminbird Matrix 35 Fishing System; 2 pages.
Humminbird Matrix 55 and 65 Operations Manual; © 2003; 40 pages.
Humminbird Matrix 67 Gps Trackplotter Operations Manual; © 2003; 88 pages.
Humminbird "Matrix 97 GPS Trackplotter Operations Manual" 2003.
Humminbird Matrix 97 Operations Manual; © 2003; 87 pages.
Humminbird Matrix™ 87c Operations Manual; © 2004; 45 pages.
Humminbird The New Wave of Wide; 1997; Humminbird Wide®; fish wide open!®; 24 pages.
Humminbird NS25 Operations Manual; 71 pages.
Humminbird Piranha 1 & 2 Operation Guide; 5 pages.
Humminbird Platinum ID 120 Operations Manual; 36 pages.
Humminbird Platinum ID 600 Operations Manual; 18 pages.
Humminbird "The Product Line>Matrix Products>Matrix 35" http://web.archive.org/web/20030404000447/www.humminbird.com/hb_Products.asp?ID, Apr. 4, 2003.
Humminbird Wide 3D Paramount Operations Manual; 44 pages.

(56) References Cited

OTHER PUBLICATIONS

Humminbird Wide 3D View Operations Manual; 38 pages.
Humminbird Wide 3D Vision Operations Manual; 38 pages.
Humminbird Wide 3D Vista Operations Manual; 38 pages.
Humminbird Wide Eye Operations Manual; 32 pages.
Humminbird Wide Paramount Operations Manual; fish wide open!; 32 pages.
Humminbird "Wideside"; Schematic; Dec. 15, 1994; 5 pages.
Hydro Products; A Tetra Tech Company; 4000 Series Gifft Precision Depth Recorder Product Brochure; date stamped 1977.
The Hydrographic Society—Corporate Member News—Kongsberg Simrad; Jul. 3, 2008; 7 pages.
Imagenex Model 855 Brochure: Online; Documents retrieved from internet web archives as follows: URL:http://web.archive.org/web/20021023212210/http:/www.imagenex.com/Products/855_858/855_858.html; 1 page; Archived on Oct. 23, 2002 URL:http://web.archive.org/web/20021024124035/http:/www.imagenex.com/Products/855_858/855/855.html; 1 page; Archived on Oct. 24, 2002 URL:http://web.archive.org/web/20021024125254/http:/www.imagenex.com/Products/855_858/858/858.html; 1 page; Archived on Oct. 24, 2002 URL:http://web.archive.org/web/20030424071306/http:/www.imagenex.com//855_Page_1.jpg; 1 page; Archived on Apr. 24, 2003 URL:http://web.archive.org/web/20030424091547/http://www.imagenex.com/855_Page_2.jpg; 1 page; Archived on Apr. 24, 2003 URL:http://web.archive.org/web/20030424094158/http:/www.imagenex.com/855_Page_3.jpg; 1 page; Archived on Apr. 24, 2003 URL:http://web.archive.org/web/20030424101301/http:/www.imagenex.com/855_Page_4.jpg; 1 page; Archived on Apr. 24, 2003 URL:http://web.archive.org/web/20030424101939/http:/www.imagenex.com/855_Page_5.jpg; 1 page; Archived on Apr. 24, 2003 URL:http://web.archive.org/web/20030424135458/http:/www.imagenex.com/855_Page_6.jpg; 1 page; Archived on Apr. 24, 2003 URL:http://web.archive.org/web/20030424141232/http:/www.imagenex.com/855_Page_7.jpg; 1 page; Archived on Apr. 24, 2003 URL:http://web.archive.org/web/20030424143158/http:/www.imagenex.com/855_Page_8.jpg; 1 page; Archived on Apr. 24, 2003.
Imagenex SportScan Digital SideScan Sonar Brochure: Online; Documents retrieved from internet web archives as follows: URL:http://web.archive.org/web/20030212030409/http://www.imagenex.com/Products/products.html; 1 page; Archived on Feb. 12, 2003 URL:http://web.archive.org/web/20030214044915/http://www.imagenex.com/Products/SportScan/sportscan.html; 1 page; Archived on Feb. 14, 2003 URL:http://web.archive.org/web/20030222152337/http://www.imagenex.com/Products/SportScan/SportScan_Specs/sportscan_specs.html; 3 pages; Archived on Feb. 22, 2003 URL:http://web.archive.org/web/20030222161450/http://www.imagenex.com/Products/SportScan/FAQ_s/faq_s.html; 4 pages; Archived on Feb. 22, 2003 URL:http://web.archive.org/web/20030419024526/http://www.imagenex.com/Products/SportScan/distributors.html; 2 page; Archived on Apr. 19, 2003.
Innomar—Products; "System Variants: SES Side Scan Option"; Retrieved from internet URL:http://www.innomar.com/produ_2000sidescan.htm; Dec. 30, 2003; 2 pages.
International Search Report and Written Opinion for Application No. PCT/US2010/039443 dated Oct. 6, 2010.
"ITC Application Equations for Underwater Sound Transducers"; Published by International Transducer Corporation, 1995, Rev. 8/00; 3 pages.
Kelvin Hughes Transit Sonar; ". . . a new dimension in shallow water survey to assist in . . . "; Hydrography; Dredging; Salvage; Underwater Construction and Similar Works; Mar. 1966; 8 pages.
Klein Digital Sonar Systems, ". . . The Next Generation From the World Leader in Side Scan Sonar and Sub-bottom Profiling Systems," 1988.
Kongsberg Brochure EA 400/600 "Sidescan Echo sounder with combined sidescan and depth soundings"; Kongsberg Maritime AS; May 2004.
Lowrance LCX-18C & LCX-19C Fish-finding Sonar & Mapping GPS; Operation Instructions; © 2002; 200 pages.
R/V Tangaroa; Fact Sheet; Explore lost worlds of the deep; Norfanz Voyage; May 10 to Jun. 8, 2003.
SeaBat 8101 Product Specification; 240kHz Multibeam Echo Sounder; © 1999 RESON Inc.; Version 4.0.
Sidefinder—Reviews & Brand Information—Techsonic Industries, Inc.; [Online]; [Retrieved on Dec. 7, 2011]; Retrieved from the Internet <URL: http://www.trademarkia.com/sidefinder-74113182.html>; 3 pages.
SIMRAD EA 500; Hydrographic Echo Sounder; Product Specifications; Revision: Sep. 1993.
Sonar Theory and Applications; Excerpt from Imagenex Model 855 Color Imaging Sonar User's Manual; Imagenex Technology Corp.; Canada; 8 pages.
Techsonic Industries, Inc.; "Mask, Acoustic"; Schematic, May 24, 1996.
Techsonic Industries, Inc.; "Element, 455 kHz"; Schematic, Jun. 13, 1996.
Trademark Electronic Search System (TESS); Word Mark: Sidefinder; [Online]; [Retrieved on Dec. 7, 2011]; Retrieved from the Internet <URL:http://tess2.uspto.gov/bin/showfield?f=doc&state=4009:qi4jkj.2.1>; 2 pages.
"Transducers Quad Beam," Prior to Aug. 2, 2003.
USACE, "Chapter 11, Acoustic Multibeam Survey Systems for Deep-Draft Navigation Projects," Apr. 1, 2004.
Westinghouse Publication; "Side-Scan Sonar Swiftly Surveys Subsurface Shellfish"; May 1970; 4 pages.
Search Report for European Application No. 12195752.6; dated Mar. 7, 2013.
Office Action for European Application No. 10728530.6, dated Apr. 2, 2013.
Office Action for European Application No. 10729001.7; dated Apr. 5, 2013.
Marine Acoustics Society of Japan (Editor); "Basics and Application of Marine Acoustics"; Apr. 28, 2004; pp. 152-172.
Humminbird® Trolling Motor Mounted Transducer with Mount Assembly Brochure; © 2008 Humminbird®, Eufaula, AL (2 pgs.).
Lowrance Transducers Product Information (1 pgs.).
International Search Report for Application No. PCT/US05/27436 dated Nov. 20, 2007; 1 page.
International Preliminary Report on Patentability for Application No. PCT/US05/27436 dated Dec. 6, 2007; 5 pages.
Translation of Notice of Reason(s) for Rejection for Japanese Application No. 2007-524919 dated Aug. 16, 2011; 4 pages.
Communication [extended European Search Report] for European Application No. 05782717.2-2220 dated Aug. 31, 2011; 12 pages.
Communication for European Patent Application No. 05782717.2-2220 dated May 11, 2012; 9 pages.
Australian Government, Department of Sustainability, Environment, Water, Population and Communities; Fact Sheet—The RV Tangaroa; date unknown; 3 pages.
Blondel, Philippe; The Handbook of Sidescan Sonar; © 2009; 316 pages.
Calcutt, Ron; Lowrance Book of Sonar & GPS; ® 1986; and Lowrance Book of Sonar & PS Update; 1997; collectively 122 pages.
Derrow, II, Robert W. et al., A Narrow-Beam, Side-Looking Sonar for Observing and Counting Fish in Shallow Aquaculture Ponds; 1996; 34 pages.
DSME E&R LTD.; Remotely Operated Sonar Boat System (SB-100S); http://dsmeu.en.ec21.com/Remotely_Operated_Sonar_Boat_System-618904_2479905.html; printed on Feb. 12, 2010; 3 pages.
Eagle Electronics; Ultra 3D Installation and Operation Manual; ® 2002; 24 pages.
Furuno Electric Co., LTD.; Side Looking Sonar, Model SL-16, 1983; 4 pages.
Geoacoustics; GeoPulse, Profiler System; Feb. 2006, 2 pages.
Humminbird 1198C Review for Catfishing, Catfishing "How To" Catfishing Techniques, Oct. 31, 2011, 9 pages.
Imagenex Technology Corp., Model 881 SportScan, Single or Dual Frequency Digital Sidescan Sonar, Software User's Manual; May 9, 2003; 16 pages.

(56) References Cited

OTHER PUBLICATIONS

Klein Associates, Inc.; Modular Side Scan Sonar and Sub-Bottom Profiler System Components for Customized Configurations; date unknown; 10 pages.
Klein, Martin; Side Scan Sonar; UnderSea Technology; Apr. 1967; 4 pages.
Klein, M. et al., Sonar—a modern technique for ocean exploitation; IEEE Spectrum; Jun. 1968; pp. 40-46 and Authors page.
Klein, Martin; New Developments in Side Scan Sonar for Hydrography; date unknown; 14 pages.
Klein, Martin; Side Scan Sonar; Offshore Services; Apr. 1977, pp. 67, 68, 71, 72, 75.
Klein, Martin; New Capabilities of Side Scan Sonar Systems; date unknown; pp. 142-147.
Klein, Martin; Sea Floor Investigations Using Hybrid Analog/Digital Side Scan Sonar; date unknown; 18 pages.
Kongsberg Maritime AS; Side Looking Transducer, 200 kHz—0. 5x49, 200 kHz side looking transducer for shallow water and surveying and high resolution; date unknown; 2 pages.
Kongsberg Simrad AS; ConCat Containerised Catamaran, Inshore hydrographic curvey vessel that fits in a container, Rev. B, Apr. 2004; 4 pages.
Kvitek, Rikk et al.; Final Report, Early Implementation of Nearshore Ecosystem Database Project Tasks 2 and 3; http://seafloor.csumb.edu/taskforce/html%202%20web/finalreport.htm; Jul. 29, 1999; 92 pages.
Law, G., Sideways Glance, Side- and down-scan Imaging Open New Windows in Fishing Finding, Electronics, Nov. 2011, pp. 28-29.
Leonard, John L.; Cooperative Autonomous Mobile Robots; date unknown; 11 pages.
Maritime surveys takes delivery of SeaBat 8160; Sea Technology, Jul. 2001; http://findarticles.com/p/articles/mi_qa5367/is_200107/ai_n21475675/; webside printed Jun. 30, 2010.
Marine Sonic Technology, Ltd.; Sea Scan® PC Side Scan Sonar System Information/Specifications Sheet; Sep. 9, 2002; 10 pages.
Mesotech; Mesotech Model 971 Sonar System Summary; Mar. 26, 1985, 2 pages.
Oughterson, B., Sophisticated Sonar Reveals Detailed Images Recently Unimaginable. Is It Too Much too Soon?, Basic Instincts,pp. 75-78.
Raymarine, L750 Fishfinder, Operation Handbook; date unknown; 93 pages.
Raytheon Marine Company; Installation Instructions; Oct. 1998; 2 pages.
Remtechsroy Group; Side Scan Sonar-Remotely Operated Vehicle Surface; http://remtechnology.en.ec21.com/Side_Scan_Sonar_Remotely_Operated-2902034_2902230.html; printed on Feb. 12, 2010; 4 pages.
Reson Inc.; SeaBat 8101 Product Specification, 240kHz Multibeam Echo Sounder; © 1999; 2 pages.
Reson; SeaBat 8101; Multibeam acoustic echosounder; date unknown; 1 page.
Reson; SeaBat 8160 Product Specification, Multibeam Echosounder System; date unknown; 2 pages.
Russell-Cargill, W.G.A. ed.; Recent Developments in Side Scan Sonar Techniques; © 1982; 141 pages.
Simrad; Product Specifications, Simrad EA 500 Side-looking Option; Feb. 1992, 1 page.
Techsonic Industries, Inc., Humminbird Wide fish wide open!; brochure, 1997; 4 pages.
Techsonic Industries, Inc.; Humminbird GPS brochure; © 1992; 10 pages.
Teleflex Electronic Systems; Humminbird 1997; © 1996; 24 pages.
The Norwegian and Finnish navies performing operations with the Kongsberg Hugin AUV and minesniper mine disposal vehicle in Finnish waters; FFU nytt; No. 3, Nov. 2003; p: 12.
Trabant, Peter K.; Applied High-Resolution Geophysical Methods, Offshore Geoengineering Hazards; © 1984; 265 pages.
Tritech International Limited; StarFish; 450H Hull-Mounted Sidescan System; date unknown; 2 pages.
Universal Sonar Limited; High Frequency Broad Band Line Array Type G27/300LQ; date unknown 2 pages.
Williams, J. P., *Glancing Sideways, Nautical Know-How*, Chesapeake Bay Magazine, May 2011, pp. 14-17.
The Imagenex SportScan; Digital Sidescan Sonar; "Redefining Image Clarity"; Imagenex Technology Corp.; © 2002.
"Product Survey Side-Scan Sonar"; Hydro International Magazine; vol. 36; Apr. 2004; pp. 36-39.
Andrew, C., et al.; "Setup and Trouble shooting Procedures for the KIlein 5500 Sidescan Sonar"; Australian Government; Department of Defence; Maritime Operations Division; Systems Sciences Laboratory; Published Nov. 2003.
EM1110-2-1003; Department of the Army; U.S. Army Corps of Engineers; Engineering and Design; Hydrographic Surveying; Apr. 1, 2004.
EA 400 Survey; "A complete, integrated survey system"; Kongsberg Maritime AS; Oct. 2003.
Benthos C3D Sonar Imaging System; "High Resolution Side Scan Imagery with Bathymetry"; Benthos, Inc.; © May 2002.
SonarBeam Underwater Surveying System Using T-150P tow-fish hull mounted; [Online]; [Retrieved on Feb. 12, 2010 from the Internet <URL: http://dsmeu.en.ec21.com/Remotely_Operated_Sonar_Boat_System--618904_2479905.html; 4 pages; http://www.remtechnology.en.ec21.com/Side_Scan_Sonar_Remotely_Operated--2902034.html; 4 pages; [Retrieved on Feb. 16, 2010 from the Internet <URL: http://dsmeu.en.ec21.com/Remotely_Operated_Sonar_Boat_System--618904_2479905.html; 4 pages; http://www.remtechnology.en.ec21.com/Side_Scan_Sonar_Remotely_Operated--2902230.html; 7 pages.
Odom Echoscan™: For Sea Floor or Riverbed Surveys; Odom Hydrographic Systems; Apr. 26, 2002.
Imagenex Model 872 "Yellowfin" Sidescan Sonar; Imagenex Technology Corp.; © 2004-2009
Datasonics SIS-1000 Seafloor Imaging System; Combined Chirp Side Scan Sonar/Chirp Sub-Bottom Profiling for high resolution seafloor imaging; One System, All the Answers; Benthos, Inc.; © 2000.
FishFinder L470; Instruction Manual; Raymarine; © May 2003.
Starfish 450H; Sidescan System; Tritech International Limited; UK.
GeoPulse; GeoAcoustics Pinger Sub-Bottom Profiler; Retrieved from the Internet <URL:http://www.km.kongsberg.com/ks/web/nokbg0397.nsf/AllWeb/D1084BB7DD0FD21DC12574C0003E01EA/$file/GeoPulse_Profiler.pdf?OpenElement; GeoAcoustics Limited, UK; A Kongsberg Company.
Coastal Engineering Technical Note; "Side-Scan Sonar for Inspecting Coastal Structures"; U.S. Army Engineer Waterways Experiment Station; Revised Nov. 1983.
Glynn, Jr., J.M., et al.; "Survey Operations and Results Using a Klein 5410 Bathymetric Sidescan Sonar"; Retrieved from the Internet <URL:http://www.thsoa.org/hy07/03_04.pdf; Mar. 2007.
Asplin, R.G., et al.; "A new Generation Side Scan Sonar"; Oceans '88 Proceedings. 'A Partnership of Marine Interests'; vol. 2; Oct.-Nov. 1988; pp. 329-334.
Kvitek, R.G., et al.; "Victoria Land Latitudinal Gradient Project: Benthic Marine Habitat Characterization"; California State University; Monterey Bay; Field Report; Feb. 25, 2004.
Carey, W.M., "Sonar Array Characterization, Experimental Results"; IEEE Journal of Oceanic Engineering ; vol. 23; Issue 3; Jul. 1998; pp. 297-306.
Curcio, J., et al.; "Scout—A Low Cost Autonomous Surface Platform for Research in Cooperative Autonomy"; Department of Mechanical Engineering; Massachusetts Institute of Technology; Aug. 2005.
ONR Grant N66604-05-1-2983; Final Report; "Cooperative Autonomous Mobile Robots"; Retrieved from the Internet <URL: http://dodreports.com/pdf/ada463215.pdf; Post 2006.
Final Report; Early Implementation of Nearshore Ecosystem Database Project Tasks 2 and 3; [online]; Retrieved on Feb. 26, 2010 from the Internet <URL: http://seafloor.csumb.edu/taskforce/html%202%20web/finalreport.htm; 90 pages.
Shono, K., et al.; "Integrated Hydro-Acoustic Survey Scheme for Mapping of Sea Bottom Ecology"; Ocean Research Institute; Tokyo, Japan; Nov. 2004.

(56) References Cited

OTHER PUBLICATIONS

R/V Quicksilver; Hydrographic Survey Launch Bareboat or Crewed; F/V Norwind, Inc.
Odom Hydrographic Systems ECHOSCAN Manual; Revision 1.11; Apr. 26, 2002.
Jonsson, J., et al. "Simulation and Evaluation of Small High-Frequency Side-Scan Sonars using COMSOL"; Excerpt from the Proceedings of the COMSOL Conference; 2009; Milan, Italy.
Pryor, Donald E.; "Theory and Test of Bathymetric Side Scan Sonar"; Office of Charting and Geodetic Services; National Ocean Service; National Oceanic and Atmospheric Administration; Post 1987; pp. 379-384.
ConCAT Containerised Catamaran; Inshore hydrographic survey vessel that fits in a container; In Cooperation with Uniteam International; Kongsberg Simrad AS; Apr. 2004.
Ultra III 3D Installation and Operation Instructions; Eagle™; © 1994.
Hughes Clarke, John E., et al.; Knudsen 320 200 kHz keel-mounted sidescan trials; Results from 2000/2001/2002 field operations; [online]; Retrieved on Jun. 23, 2010 from the Internet <URL: http://www.omg.unb.ca/Ksidescan/K320_SStrials.html; 11 pages.
Lowrance HS-3DWN Transducer Assembly and Housing (Eagle IIID); Aug. 1994.
GPS Speed Correction; Sidescan Sonar; [online]; Retrieved from the Internet URL: <www.hydrakula.uni-kiel.de/downloads/Sidescan%20Sonar.doc; 10 pages.
Manley, J.E.; "Development of the Autonomous Surface Craft 'Aces'"; MTS/IEEE Conference Proceedings Oceans '97; Oct. 1997; pp. 827-832.
Navico Design Report of Raytheon Electronics Side Looker Transducer; Mar. 12, 2010; 18 pages.
NOAA: Nautical Charting general information from public records; [Online]; Retrieved on Sep. 10, 2010 from the Internet < URL: http://www.nauticalcharts.noaa.gov/csdl/learn_hydroequip.html; 2 pages; http://www.nauticalcharts.noaa.gov/csdl/learn_hydroequip.html; 1 page; http://www.nauticalcharts.noaa.gov/csdl/Pdbs.html; 2 pages; http://www.nauticalcharts.noaa.gov/hsd/pub.html; 1 page; http://www.nauticalcharts.noaa.gov/hsd/fpm/fpm.htm; 1 page; http://www.ozcoasts.gov.au/geom_geol/toolkit/Tech_CA_sss.jsp; 12 pages.
T297-00-01-01 Transducer housing outline drawing; Neptune Sonar Ltd.; © 2002.
GeoAcoustics; A Kongsberg Company; GeoSwath Plus Brochure; "Wide swath bathymetry and georeferenced side scan"; [Online]; Retrieved from the internet < URL: http://www.km.kongsberg.com/ks/web/nokbg0397.nsf/AllWeb/F4B7FD3461368388C1257599002D34BC/$file/GeoSwath-Plus-brochure.pdf?OpenElement.
U-Tech Company Newsletter.
Various IMAGENEX Technical Specifications and User's Manual; Prior to Aug. 2003.
Humminbird® Trolling Motor Mounted Transducer with Mount Assembly Brochure; © 2008 Humminbird®, Eufaula, AL; 2 pages.
Lowrance Transducers Product Information; 1 page.
Office Action for Japanese Application No. 2012-267270 dated Dec 2, 2013.
Tokuyama, H. et al., *Principles and Applications of Izanagi Oceanfloor Imaging Sonar System*, Journal of the Japan Society of Photogrammetry and Remote Sensing, vol. 29, No. 2, 1990, pp. 76-83.
Yamamoto, F. et al., *Oceanfloor Imaging System—Izanagi*, Journal of the Japan Society for Marine Surveys and Technology 1 (2), Sep. 1989, pp. 45-51, 53 and 54.
Imagenex Technology Corp.; YellowFin SideScan Sonar, (Model 872); user's manual; data storage file format; Ethernet interface specification, and Ethernet setup guide; Nov. 2004; 46 pages.
Office Action for Reexamination No. 90/009,956; dated Apr. 6, 2012; 32 pages.
Office Action for Reexamination No. 90/009,957; dated Jun. 4, 2012; 17 pages.
Office Action for Reexamination No. 90/009,958; dated Jun. 18, 2012; 19 pages.
Office Action for U.S. Appl. No. 11/195,107; dated Feb. 15. 2007; 5 pages.
Office Action for U.S. Appl. No. 11/195,107; dated Aug. 9, 2007; 7 pages.
Office Action for U.S. Appl. No. 11/195,107; dated Mar. 4, 2008; 7 pages.
Office Action for U.S. Appl. No. 11/195,107; dated Jul. 17, 2008; 7 pages.
Office Action for U.S. Appl. No. 11/195,107; dated May 12, 2009; 9 pages.
Office Action for U.S. Appl. No. 12/319,594; dated Jun. 8, 2009; 10 pages.
Office Action for U.S. Appl. No. 12/319,586; dated Sep. 3, 2009; 5 pages.
Office Action for U.S. Appl. No. 12/319,586; dated Mar. 2, 2010; 5 pages.
Office Action for U.S. Appl. No. 12/319,604; dated Sep. 29, 2009; 7 pages.
Office Action for U.S. Appl. No. 12/631,229; dated Sep. 9, 2010, 8 pages.
Response to European Search Report for European Patent Application No. 05782717.2-2220; dated Mar. 23, 2012; Johnson Outdoors, Inc.; 35 pages.
De Jong, C. D., et al.; "*Hydrography: Series on Mathematical Geodesy and Positioning*;" VSSD; ISBN 90-407-2359-1; dated 2002.
Berktay, H. O., et al.; "*Farfield performance of parametric transmitters*;" Journal of Acoustical Society of America, vol. 55, No. 3; dated Mar. 1974.
Fried, N. W.; "*An Investigation of a Large Step-Down Ratio Parametric Sonar and Its Use in Sub-Bottom Profiling*;" Thesis: Simon Fraser University; dated Aug. 1992.
Hardiman, J. E., et al.; "*High Repetition Rate Side Looking Sonar*;" Oceans 2002 MTSIEEE, vol. 4; dated Oct. 2002.
Naoi, J., et al.; "*Sea Trial Results of a Cross Fan Beam Type Sub-Bottom Profiler*;" Japanese Journal of Applied Physics, vol. 39, No. 5; dated May 2000.
Plueddemann, A. J., et al.; "*Design and Performance of a Self-Contained Fan-Beam ADCP*;" IEEE Journal of Oceanic Engineering, vol. 26, No. 2; dated Apr. 2001.
Riordan, J., et al.; "*Implementation and Application of a Real-time Sidescan Sonar Simulator*;" Oceans 2005—Europe, vol. 2; dated Jun. 2005
Yang, L., et al.; "*Bottom Detection for Multibeam Sonars with Active Contours*;" MTSIEEE Conference Proceedings, vol. 2; dated Oct. 1997.
"*100 W adjustable Wide-Beam: Transom-Mount Transducer—P48W*;" Airmar Technology Corporation; <www.airmar.com>.
Extended European Search Report for Application No. 13153403.4; dated May 7, 2013.
Humminbird Wide Optic Operations Manual 1997; fish wide open!: 32 pages.
Humminbird Wide Brochure 1997; fish wide open!; 4 pages.
Humminbird 997c SI Combo Installation and Operations Manual 2008; 151 pages.
Humminbird 757c, 787c2 and 757c2i GPS Chartplotter Operations Manual 2006; 161 pages.
Lowrance Electronics, Inc.; X-70A 3D Installation and Operation Instructions; 44 pages.
Raymarine: DSM25 Digital Sounder Module Owner's Handbook; 62 pages.
Raymarine: A65 GPS Chartplotter Owners Handbook; © Raymarine 2006; 100 pages.
Raymarine: E-series Networked Display: Reference Manual; Mar. 2006; 51 pages.
Kongsberg Publication; Pohner, Freddy et al.; Integrating imagery from hull mounted sidescan sonars with multibeam bathymetry: 16 pages.
Airmar Technology Corporation, R209 Dual Frequency 2 to 3 W Transducer; Oct. 10, 2007; 2 pages.
Airmar Technology Corporation, R99 Dual Frequency 2kW Transducer; May 2, 2006; 2 pages.

(56) References Cited

OTHER PUBLICATIONS

DeRoos, Bradley G. et al., Technical Survey and Evaluation of Underwater Sensors and Remotely Operated Vehicles; May 1993; 324 pages.
Klein Associates, Inc., Klein Hydroscan System, 1983; 52 pages.
Office Action for Japanese Application No. 2013-037874 dated Mar. 26, 2014.
Petition for Inter Partes Review of U.S. Patent No.: 8,305,840; IPR2013-00355; dated Jun. 13, 2013; Raymarine, Inc.; 63 pages.
Declaration of Paul Stokes for Inter Partes Review of U.S. Patent No.: 8,305,840; IPR2013-00355; dated Jun. 12, 2013; Raymarine, Inc.; 118 pages.
Patent Owner's Preliminary Response; Inter Partes Review of U.S. Patent No.:.8,305,840; IPR2013-00355; dated Sep. 17, 2014; Navico Holding AS; 110 pages.
Decision for Inter Partes Review of U.S. Patent No. 8,305,840; IPR2013-00355; dated Dec. 12, 2013; United States Patent and Trademark Office; 36 pages.
Judgment of Inter Partes Review of U.S. Patent No. 8,305,840; IPR2013-.00355; dated Mar. 25, 2014; United States Patent and Trademark Office; 3 pages.
Petition for Inter Partes Review of U.S. Patent No. 8,305,840; IPR2013-00496; dated Aug. 6, 2013; Raymarine, Inc.; 63 pages.
Declaration of Paul Stokes for Inter Partes Review of U.S. Patent No.: 8,305,840; IPR2013-00496; dated Aug. 2, 2013; Raymarine, Inc.; 124 pages.
Patent Owner's Preliminary Response; Inter Partes Review of U.S. Patent No.: 8,305,840; IPR2013-00496 ; dated Sep.17, 2014; Navico Holding AS; 114 pages.
Decision for Inter Partes Review of U.S. Patent No. 8,305,840; IPR2013-00496; dated Feb. 11, 2014; United States Patent and Trademark Office; 14 pages.
Judgment of Inter Partes Review of U.S. Patent No. 8,305,840; IPR2013-00496; dated Mar. 25, 2014; United States Patent and Trademark Office; 3 pages.
Petition for Inter Partes Review of U.S. Patent No. IPR2013-00497; dated Aug. 6, 2013; Raymarine, Inc.; 64 pages.
Declaration of Paul Stokes for Inter Partes Review of U.S. Patent No.: 8,305,840; IPR2013-00497; dated Aug. 2, 2013; Raymarine, Inc.; 166 pages.
Patent Owner's Preliminary Response; Inter Partes Review of U.S. Patent No.: 8,305,840; IPR2013-00497; dated Sep. 17, 2014; Navico Holding AS; 102 pages.
Decision for Inter Partes Review of U.S. Patent No.: 8,305,840; IPR2013-00497; dated Feb. 11, 2014; United States Patent and Trademark Office; 17 pages.
Judgment of Inter Partes Review of U.S. Patent No.: 8,305,840; IPR2013-00497;Mar. 25, 2014; United States Patent and Trademark Office; 3 pages.
Supplemental Response to second set of Interrogatories; International Trade Commission; Investigation No. 337-TA-898; dated Jan. 6, 2014; Raymarine, Inc.; 12 pages.
Invalidity Contention; U.S. Patent No. 8,305,840 Invalidity Claim Chart; Exhibit A01—Hydrography; Feb. 12, 2014; 30 pages.
Invalidity Contention; U.S. Patent No. 8,305,840 Invalidity Claim Chart; Exhibit A02—Hydrography, Lustig; Feb. 12, 2014; 42 pages.
Invalidity Contention; U.S. Patent No. 8,305,840 Invalidity Claim Chart; Exhibit A03—Hydrography, Adams; Feb. 12, 2014; 49 pages.
Invalidity Contention; U.S. Patent No. 8,305,840 Invalidity Claim Chart; Exhibit A04—Hydrography, Boucher '522; Feb. 12, 2014; 39 pages.
Invalidity Contention; U.S. Patent No. 8,305,840 Invalidity Claim Chart; Exhibit A05—Hydrography, Boucher '522, Adams; Feb. 12, 2014; 54 pages.
Invalidity Contention; U.S. Patent No. 8,305,840 Invalidity Claim Chart; Exhibit A06—Hydrography, Adams, Betts; Feb. 12, 2014; 29 pages.
Invalidity Contention; U.S. Patent No. 8,305,840 Invalidity Claim Chart; Exhibit A07—Hydrography, Boucher '522, Adam, Betts; Feb. 12, 2014; 33 pages.
Invalidity Contention; U.S. Patent No. 8,305,840 Invalidity Claim Chart; Exhibit A08- Hydrography, Boucher '798, DeRoos, Adams; Feb. 12, 2014; 46 pages.
Invalidity Contention; U.S. Patent No. 8,305,840 Invalidity Claim Chart; Exhibit A09—Hydrography, Boucher '798, DeRoos, Adams, Betters; Feb. 12, 2014; 33 pages.
Invalidity Contention; U.S. Patent No. 8,305,840 Invalidity Claim Chart; Exhibit A10—Furuno; Feb. 12, 2014; 58 pages.
Invalidity Contention; U.S. Patent No. 8,305,840 Invalidity Claim Chart; Exhibit A11—Airmar P48; Feb. 12, 2014; 70 pages.
Invalidity Contention; U.S. Patent No. 8,305,840 Invalidity Claim Chart; Exhibit A12—Russell-Cargill et al; Feb. 12, 2014; 89 pages.
Invalidity Contention; U.S. Patent No. 8,305,840 Invalidity Claim Chart; Exhibit A13—Kongsberg EA 400/600; Feb. 12, 2014; 57 pages.
Invalidity Contention; U.S. Patent No. 8,305,840 Invalidity Claim Chart; Exhibit A14—Sato; Feb. 12, 2014; 6 pages.
Invalidity Contention; U.S. Patent No. 8,305,840 Invalidity Claim Chart; Exhibit A15—Chiang, E-Series; Feb. 12, 2014; 5 pages.
Invalidity Contention; U.S. Patent No. 8,305,840 Invalidity Claim Chart; Exhibit A16—Bird, Wilcox, Nishimori, Hamada, Blue, Fatemi-Boosheri, Boucher '798, Thompson, Betts, Zimmerman, P48, Tri-Beam, Imagenex, Odom Echoscan; Feb. 12, 2014; 40 pages.
Invalidity Contention; U.S. Patent No. 8,305,840 Invalidity Claim Chart; Exhibit A17—Hydrography, Humminbird 997c, Betts; Feb. 12, 2014; 69 pages.
Invalidity Contention; U.S. Patent No. 8,305,840 Invalidity Claim Chart; Exhibit A18—Humminbird 997c; Feb. 12, 2014; 83 pages.
Invalidity Contention; U.S. Patent No. 8,305,840 Invalidity Claim Chart; Exhibit A19—Betts; Feb. 12, 2014; 49 pages.
Invalidity Contention; U.S. Patent No. 8,300,499 Invalidity Claim Chart; Exhibit B01—Tri-Beam; Feb. 12, 2014; 31 pages.
Invalidity Contention; U.S. Patent No. 8,300,499 Invalidity Claim Chart; Exhibit B02—Hydrography, Humminbird 757 c; Feb. 12, 2014; 38 pages.
Invalidity Contention; U.S. Patent No. 8,300,499 Invalidity Claim Chart; Exhibit B03—Airmar-R209, Humminbird 757 c; Feb. 12, 2014; 43 pages.
Invalidity Contention; U.S. Patent No. 8,300,499 Invalidity Claim Chart; Exhibit B04—Airmar-R209, Hydrography, Humminbird 757c, Sato, Aimar-R99, Zimmerman; Feb. 12, 2014; 59 pages.
Invalidity Contention; U.S. Patent No. 8,300,499 Invalidity Claim Chart; Exhibit B05—Odom Echoscan; Feb. 12, 2014; 45 pages.
Invalidity Contention; U.S. Patent No. 8,300,499 Invalidity Claim Chart; Exhibit B06—Kongsberg EA 400/600; Feb. 12, 2014; 37 pages.
Invalidity Contention; U.S. Patent No. 8,300,499 Invalidity Claim Chart; Exhibit B07—Nishimori, Thompson, Betts, Zimmerman, Melvin, Tri-Beam, Odom Echoscan; Feb. 12, 2014; 22 pages.
Invalidity Contention; U.S. Patent No. 8,300,499 Invalidity Claim Chart; Exhibit B08—Hydrography, Betts et al, Humminbird 997c and 757c; Feb. 12, 2014; 61 pages.
Invalidity Contention; U.S. Patent No. 8,300,499 Invalidity Claim Chart; Exhibit B09—Humminbird 997c; Feb. 12, 2014; 40 pages.
Invalidity Contention; U.S. Patent No. 8,300,499 Invalidity Claim Chart; Exhibit B10—Betts; Feb. 12, 2014; 29 pages.
Supplemental Response to Interrogatories, Exhibit 1; International Trade Commission; dated Feb. 28, 2014; Navico Holding AS.; 114 pages.
Supplemental Response to Interrogatories, Exhibit 2; International Trade Commission; dated Feb. 28, 2014; Navico Holding AS.; 67pages.
PCT International Search Report and Written Opinion; PCT/IB2013/060285; Feb. 18, 2014.
PCT International Search Report and Written Opinion; PCT/us2013/047869; Oct. 21, 2013.
PCT International Search Report and Written Opinion; PCT/IB2013/048177; Oct. 21, 2013.
PCT International Search Report and Written Opinion; PCT/IB2013/048129; Oct. 17, 2013.
PCT International Search Report and Written Opinion; PCT/IB2013/047926; Oct. 11, 2013.

(56) References Cited

OTHER PUBLICATIONS

PCT International Search Report and Written Opinion; PCT/IB2013/047645; Sep. 27, 2013.
Airmar Press Release: *Airmar Introduces P48W 200kHz Adjustable, Wide-Beam, Transom-Mount: Industry's widest 200kHz transducer can help win fishing tournaments* (Apr. 23, 2009).
Airmar Technology Corporation Brochure/Presentation: Guide to Transducer Technology (Aug. 18, 2010).
Airmar Technology Corporation Datasheet: P48W Transom-Mount Adjustable Wide-Beam, (Dec. 2010).
Owner's Guide & Installation Instructions, Transam or Tolling Motor Mount,Chirp or Adjustable Wide-beam Transducer, Models: P48W, TM130M, TM150M, TM210H (2013).
Airmar Technology Corporation Brochure DST800 Retractable Transducer System Sep. 2005.
Garmin GPSMAP 3206/3210 Color Chartplotter Owner's Manual (Jun. 2006).
GeoAcoustics, GeoSwath Operation Manual Swath 6100/B (Sep. 1998).
GeoAcoustics, GeoSwath Product Bulletin (2000).
Hogarth, P., Low Cost Swath Bathymetry: Widening the swath bathymetry market, Hydro International (Jul. 2000).
Datasheet / Specification for Imagenex Sportscan, (Aug. 2005).
Imagenex Model 858 User's Manual (May 1999).
Imagenex Model 855 User's Manual (Nov. 1991).
Imagenex Sportscan Installation / Setup Manual (date unknown).
Product News, Versatile Side-Scan Sonar: JW Fishers developed a side-scan towfish with adjustable transducers, Hydro International, (Feb. 2008) http://.hydro-international.com/news/id2531-VersatileSidescanSonar.html.
Side Scan PC Operation Manual: SSS-100k PC, SSS-600K PC, SSS-100k/600K PC Side Scan Sonar Operation and Maintenance Manual, JW Fishers MFG Inc (date unknown).
Klein Associates Brochure: Hydroscan for Pipeline Survey (date unknown).
Klein Associates Brochure: Klein Smartfish, A Proven Platform for Deep Tow Applications (date unknown).
Klein Associates Brochure: System 3900—Dual-Frequency Side Scan Sonar for Search and Recovery (Nov. 2008).
Klein Associates Product Catalog Supplement: Sub-Bottom Profiler & Microprofiler (Supplement to HYDROSCAN catalog) (Nov. 1983).
Klein Hydroscan Applications Bulletin: Oil and Gas Pipeline Routing, Laying and Inspection, (Jan. 1983).
Kucharski, William M., and Clausner, James E., Underwater Inspection of Coastal Structures Using Commercially Available Sonars, Technical Report REMR-CO-11, US Army Corps of Engineers, Department of the Army (Feb. 1990).
Mazel, Charles H., Inspection of Surfaces by Side Scan Sonar, Proceedings of the Remotely Operated Vehicles Conference and Exposition, (1984).
EA 400/600 Sidescan: Echo Sounder with Combined Sidescan and Depth Soundings, Konigsberg Maritime AS, (Nov. 2005).
SIMRAD EK 500 Fishery Research Echo Sounder Installation Manual (Jun. 2006).
SIMRAD EK 500 Fishery Research Echo Sounder Operator Manual (May 1996).
Avera W., et al., Multibeam Bathymetry from a Mine-Hunting Military Sonar, Report No. NRL/JA/7440-02-1010, Naval Research Laboratory and Naval Oceanographic Office, (Nov. 2002).
Barbu, Madalina, "Acoustic Seabed and Target Classification using Fractional Fourier Transform and Time-Frequency Transform Techniques" Dissertation Paper 480, University of New Orleans (2006).
Barbu, C., et al., AQS-20 Sonar Processing Enhancement for Bathymetry Estimation, pp. 1-5, Presented at OCEANS Conference (2005).
Buchanan, H.L. and Lt. Cmdr. John M. Cottingham, Countering Mines in 2005, Sea Technology, vol. 41, No. 1, pp. 24-29, (Jan. 2000).
Elmore, P.A., et al., Environmental Measurements Derived from Tactical Mine Hunting Sonar Data, pp. 1-5, Presented at OCEANS Conference (2007).
Elmore, P.A. et al., Use of the AN/AQS-20A Tactical Mine-hunting System for On-scene Bathymetry Data, Journal of Marine Systems, vol. 78, pp. 5425-5432(Feb. 2008).
Gallaudet, T.C., et al., Multibeam Volume Acoustic Backscatter Imagery and Reverberation Measurements in the Northeastern Gulf of Mexico, J. Acoust. Soc. Am., vol. 112, No. 2, pp. 489-503 (Aug. 2002).
Harris, M.M., et al., Tow Vehicle Depth Verification, Oceans 2002 IEEE/MTS Conference Proceedings, pp. 1199-1202 (Oct. 2002).
Streed, C.A., et al., AQS-20 Through-The-Sensor Environmental Data Sharing, Proceedings of the SPIE Defense & Security Symposium (Mar. 2005).
Taylor, W.A., et al., Taking the Man out of the Minefield, Sea Technology 2007, vol. 48, No. 11, pp. 15-19 (Nov. 2007).
Kelly, D., The Scoop on Scanning Sonar, Motor Boating and Sailing, pp. 51, 70-71 (Aug. 1976).
Sosin, M., Can Electronics Make You Almost as Smart as a Fish, Popular Mechanics, pp. 110-111 (Nov. 1976).
WESMAR Brochure: Wesmar's New HD800 Sonar (date unknown).
Wesmar Sonar Effective in Shallow-Water Operations Literature Available, Maritime Reporter and Engineering News, p. 13 (Dec. 15, 1983).
Denny, M., Blip, Ping, and Buzz, JHU Press, 1st ed. (2007).
Flemming, B.W., M. Klein, P.M. Denbigh, Recent Developments in Side Scan Sonar Techniques, (1982).
Hansen, R.E., Introduction to Sonar, Course Material to INF-GEO4310, University of Oslo, (Oct. 7, 2009).
Kurie, F.N.D. Design and Construction of Crystal Transducers, Office of Scientific Research and Development Washington D C., (1946).
Loeser, Harrison T., Sonar Engineering Handbook, Peninsula Publishing (1992).
Medwin, H. et al., Fundamentals of Acoustical Oceanography, Academic Press (1998).
Miller, S.P., Selected Readings in Bathymetric Swath Mapping, Multibeam Sonar System Design, University of California Santa Barbara (Apr. 1993).
Sherman, C. & J. Butler, Transducers and Arrays for Underwater Sound, Springer Sci. & Bus. Media, 1st ed. (2007).
Stansfield, D., High Frequency Designs, Underwater Electroacoustic Transducers: A Handbook for Users and Designers, Bath University Press and Institute of Acoustics (1991).
Urick, R.J., Principles of Underwater Sound, 3rd Edition, McGraw-Hill Book Company, 1983.
Wilson, O.B., An Introduction to the Theory and Design of Sonar Transducers, Navy Postgraduate School, Monterey, California (Jun. 1985).
Woollett, R.S., Sonar Transducer Fundamentals, Scientific and Engineering Studies, Naval Underwater Systems Center (1984).
Bass, G. New Tools for Undersea Archeology, National Geographic, vol. 134, pp. 403-422 (1968).
Chesterman, W.D., Clynick, P.R., and Stride, A.H., An Acoustic Aid to Sea Bed Survey, Acustica, pp. 285-290, Apr. 1958.
Cyr, Reginald, A Review of Obstacle Avoidance/Search Sonars Suitable for Submersible Applications, Marine Tech. Soc. Journal., vol. 20, No. 4, pp. 47-57(Dec. 1986).
Donovan, D.T., Stride, A.H., and Lloyd, A.J., An Acoustic Survey of the Sea Floor South of Dorset and its Geological Interpretation, Philosophical Transactions of the Royal Society of London Series B, Biological Sciences, pp. 299-330 (Nov. 1961).
Flemming, B.W., Side-Scan Sonar: A Practical Guide, International Hydrographic, pp. 65-92 (Jan. 1976).
Hersey, J. B, et al., Somar Uses in Oceanography, Presented at Instrument Automation Conference and Exhibit, New York, NY, Sep. 1960.
Hydro Surveys: Side Scan Sonar Systems Hydro International (2008).
Morang, Andrew, Kucharski, William M., Side-Scan Investigation of Brrakwates at Calumet and Burns Harbors in Southern Lake Michigan, Oceans 86 Conference, pp. 458-465, Sep. 1986.

(56) References Cited

OTHER PUBLICATIONS

Newman, P., Durrant-Whyte, H., Using Sonar in Terrain-Aided Underwater Navigation, IEEE Proceedings, (May 1998).
Noble, N., The Telltale Sound of Depth, Motor Boating and Sailing, pp. 23-24(Aug. 1976).
Pappalardo, M., Directivity Pattern of a Linear Array Transducer in High Frequency Range, Journal de Physique, pp. 32-34 (Nov. 1972).
Patterson, D.R., and J. Pop, Coastal Applications of Side Scan Sonar, Proceedings of Coastal Structures '83, Mar. 1983.
Onoe, M., and Tiersten, H.F., Resonant Frequencies of Finite Piezoelectri Ceramic Vibrators with High Electromechanical Coupling, IEEE Transactions of Ultrasonics Engineering, pp. 32-39 (Jul. 1963).
Rusby, Stuart, A Long Range Side-Scan Sonar for Use in the Deep Sea (Gloria Project) Int. Hydrogr. Rev., pp. 25-39 (1970).
Rossing, Thomas D., Sonofusion??, ECHOES: The Newsletter of the Acoustical Society of America, vol. 12, No. 2 (Spring. 2002).
Somers, M.L., and Stubbs, A.R., Sidescan Sonar, IEE Proceedings, pp. 243-256, Jun. 1984.
Spiess, F.N., Acoustic Imaging, Society of Photo-optical Instrumentation Engineers' Seminar-in-Depth on Underwater Photo-optical Instrumentation Application, pp. 107-115 (Mar. 1971.).
Stride, A.H., A Linear Pattern on the Sea Floor and its Interpretation, National Institute of Oceanography, Wormley, Surrey, pp. 313-318 (1959).
Tyce, R.C., Deep Seafloor Mapping Systems A Review, Marine Tech. Soc. Journal., vol. 20, No. 4, pp. 4-16 (Dec. 1986).
Wang, H.S.C., Amplitude Shading of Sonar Transducer Arrays, The Journal of the Acoustical Society of America, pp. 1076-1084, (May 1975).
Benthien, George W, and Hobbs, Stephen, Technical Report: Modeling of Sonar Transducers and Arrays, Sep. 2005.
Barnum, S.R. CDR, Descriptive Report to Accompany Hydrographic Survey Side, Scan Sonar / Multibeam Survey of Portsmouth Harbor, Survey No. H11014 (2001).
Clausner, J. Coastal Engineering Technical Note: Side Scan Sonar for Inspecting Coastal Structures, CETN-III-16, U.S. Army Engineer Waterways Experiment Station, (Nov. 1983).
Craig, J.D., Engineering and Design: Evaluation and Repair of Concrete Structures, Manual No. 1110-2-2002, US Army Corps of Engineers, Department of the Army (Jun. 1995).
McMillan, Ken, The Application of Sector Scanning Sonar Technology to the Mapping of Granular Resources on the Beaufort Shelf using the Sea-Ice as a Survey Platform, McQuest Marine Research and Development Company, Report Prepared Geological Survey of Canada Atlantic, (Mar. 1997).
Ronhovde, A., High Resolution Beamforming of Simrad EM3000 Bathymetric Multibeam Sonar Data, Cand Scient thesis, University of Oslo, Norway. (Oct. 1999)
Speiss, F.N., and Tyce, R.C., Marine Physical Laboratory Deep Tow Instrumentation System, Deep Submergence Systems Project and Office of Naval Research, Report No. MPL-U-69/72, (Mar. 1973).
Williams, S. Jeffress, Use of High Resolution Seismic Reflection and Side-Scan Sonar Equipment for Offshore Surveys, CETA 82-5, U.S. Army Corps of Engineers Coastal Engineering Research Center (Nov. 1982).
EdgeTech 2000-CSS Integrated Coastal System Subscan Brochure (date unknown).
HyPack Inc,: HyPack Software User Manual (date unknown).
L-3 Communications SeaBeam Instruments Technical Reference: Multibeam Sonar Theory of Operation, (2000).
QPS b.v.,: Qinsy User Manual (Apr. 27, 2004).
SIMRAD Kongsberg EM Series Multibeam Echo Sounder Operators Manual (2000).
Tritech Technical Data Sheet: ROV/AUV Side Scan—Sea King Side Scan Sonar (date unknown).
Tritech Manual: Starfish Hull Mount Sonar System User Guide (date unknown).
Triton Elics Intl.: ISIS Sonar® User's Manual, vols. 1 and 2 (Jun. 2004).
Vernitron Product Catalog: Modern Piezoelectric Ceramics, Custom Material Product Catalog (date unknown).
Oceanic Imaging Consultants (OIC) Inc.: GeoDAS SDV Geophysical Data Acquisition System Brochure.
Clausner, J.E. and Pope, J., 1988. "Side-scan sonar applications for evaluating coastal structures"; U.S. Army Corps of Engineers, Technical Report CERC-88-16; 80 pages.
Garmin; GPSMAP ® 4000/5000 Series, Owner's Manual; 2007; 54 pages.
Hare, M.R., "Small-Boat Surveys in Shallow Water", 2008 Institute of Ocean Sciences, Marine habitat mapping Technology for Alaska; 19 pages.
Hayes, M.P. and Ho, T.Y., 2000. "Height estimation of a sonar towfish from sidescan imagery", Hamilton: Proc. Image Vision Computing New Zealand; 6 pages.
Humminbird 1100 Series Operations Manual; © 2007; 196 pages.
Imagenex Technology Corp., Model 881 Digital Tilt Adjust Imaging Sonar; Hardware Specifications; Aug. 12, 2002; 3 pages.
Klein Associates, Inc.; 1985, "Side Scan Sonar Training Manual", Side Scan Sonar Record Interpretation; 151 pages.
Mazel, C. H., 1984 "Inspection of Surfaces by Side-Scan Sonar," ROV '84 Remotely Operated Vehicle Conference of the Marine Technology Society, 7 pages.
SOLAS Chapter V; Safety of Naigation, Jul. 1, 2002; [Online]; Retrieved from the Internet URL:https://www.gov.uk/government/uploads/system/uploads/attachment_data/file/343175/solas_v_on_safety_of_navigation.pdf.
Tucker, M. J., and Stubbs, A. R., "Narrow-beam echo-ranger for fishery and geological investigations", British Journal of Applied Physics vol. 12:3 pp. 103-110 (1961).
Montgomery, E.T., et al., "Documentation of the U.S. Geological Survey Oceanographic Time-Series Measurement Database", USGS Open-File Report 2007-1194; 2 pages.
WESMAR; 500SS Sidescan Brochure; Feb. 1985; 2 pages.
WESMAR; 500SS Side Scan Brochure; May 1998; 2 pages.
WESMAR; 500SS Side Scan Owner's Manual; 82 pages.
WESMAR; SHD 700SS; "Super High Definition Side Scan Sonar with Color Video Display Capability", Operations Manual, May 1998, 45 pages.
Wesmar; SHD 700SS Super High Definition Side Scan Sonar; date unknown; 4 pages.
Wilson, D., "Side Scan Sonar: The Key to Underwater Survey", Flinders Archaeology Blog, Oct. 25, 2011, 4 pages.
Layton, J., Strickland, J., Bryant, C.W., How Google Earth Works, HowStuffWorks, Mar. 25, 2010, 2 pages; [Online]; Retrieved from Internet URL: http://wayback.archive.org/web/20100425042606/http://computer.howstuffworks.com/internet/basics/google-earth7.htm.

* cited by examiner

SYSTEM FOR INTERCHANGEABLE MOUNTING OPTIONS FOR A SONAR TRANSDUCER

FIELD OF THE INVENTION

Embodiments of the present invention relate generally to mounting sonar transducers, and more particularly, to systems and apparatuses for interchangeable mounting options for a sonar transducer.

BACKGROUND OF THE INVENTION

Sonar (SOund Navigation And Ranging) has long been used to detect waterborne or underwater objects. For example, sonar devices may be used to determine depth and bottom topography, detect fish, locate wreckage, etc. In this regard, due to the extreme limits to visibility underwater, sonar is typically the most accurate way to locate objects underwater. Sonar transducer elements, or simply transducers, convert electrical energy into sound or vibrations at a particular frequency. A sonar sound beam is transmitted into and through the water and is reflected from objects it encounters. The transducer receives the reflected sound (the "sonar returns") and converts the sound energy into electrical energy. Based on the known speed of sound, it is possible to determine the distance to and/or location of the waterborne or underwater objects. The sonar return signals can also be processed to be displayed in graphical form on a display device, giving the user a "picture" of the underwater environment. The signal processor and display may be part of a unit known as a "sonar head" that is connected by a wire to the transducer mounted remotely from the sonar head. Alternatively, the sonar transducer may be an accessory for an integrated marine electronics system offering other features such as GPS, radar, etc.

Mounting of transducers may vary depending on a number of factors, including the design of the watercraft (e.g., boat or motor) to which it may be mounted. For example, a transducer may be mounted with a transom mounting, a portable mounting, a thru-hull mounting, a trolling motor mounting, an over-the-side mounting, or other hull or structure mounting options. Different mountings, however, require different features and often optimizing features for one type of mounting may create difficulties or be undesirable for another type of mounting.

BRIEF SUMMARY OF THE INVENTION

Since different users need different kinds of mounting options for the sonar transducer, the manufacturer of sonar systems has to either sell the sonar head and the transducer separately, or cause the marine electronics dealer to inventory a number of versions of the same sonar system, the versions differing only in terms of the configuration of the transducer unit. These differences may be mechanical or electrical, or relate to the transducer's capabilities. However, selling the sonar head and transducer unit separately may be confusing for the consumer. One solution has been to sell the sonar system with the most popular type of transducer unit (e.g., configured for a transom mount) and allow the customer to exchange the transducer unit for another type if needed. This, however, requires extra effort for the customer and the dealer.

To avoid such problems and create ease for the customer, embodiments of the present invention provide systems and apparatuses for interchangeable mounting options for a transducer housing. Such a system may provide for interchangeable mounting options for watercraft, such as hull (e.g., transom) mounting, portable mounting, trolling motor mounting, and thru-hull mounting. In one example embodiment, a system for interchangeable mounting options of a sonar transducer to a watercraft is provided. The system may comprise at least one transducer, a transducer housing configured to house the at least one transducer, and a mount adapter. The transducer housing may comprise at least one upper engagement surface configured to adjacently engage the mount adapter to facilitate mounting. The at least one upper engagement surface may be configured to releasably engage the mount adapter to allow the mount adapter to be detached and removed without damaging or altering the transducer housing.

In another embodiment, a transducer housing configured for interchangeable mounting options for a boat is provided. The transducer housing is configured to house at least one transducer and comprises at least one upper engagement surface configured to adjacently engage a first mount adapter to facilitate a first type of mounting. The transducer housing further comprises at least one lower engagement surface configured to adjacently engage a second mount adapter to facilitate a second type of mounting as an alternative to the first type of mounting.

In yet another embodiment, a system for interchangeable mounting options of a sonar transducer to a boat is provided. The system comprises at least one transducer, a transducer housing configured to house the at least one transducer, and a trolling motor mount adapter. The transducer housing comprises at least one lower engagement surface configured to adjacently engage the trolling motor mount adapter to facilitate mounting on a trolling motor.

In another embodiment, a trolling motor mount adapter for a transducer housing configured for interchangeable mounting options for a boat is provided. The trolling motor mount adapter is configured to removably receive the transducer housing. The trolling motor mount adapter comprises a hole with a perimeter configured to engage the transducer housing such that the transducer housing fits at least partially in the hole.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
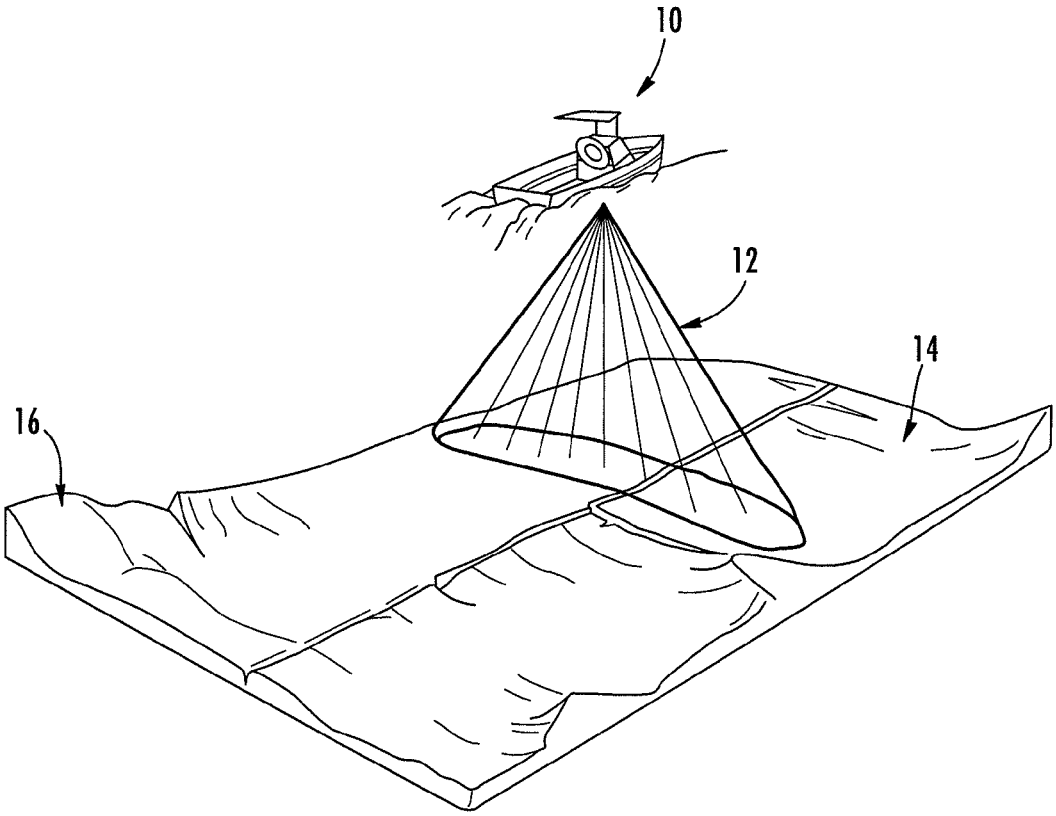
FIG. 1 is a diagram illustrating an example of a sonar transducer producing an array of sound waves from a boat.

Exemplary embodiments of the present invention now will be described more fully hereinafter with reference to the accompanying drawings, in which some, but not all embodiments of the invention are shown. Indeed, the invention may be embodied in many different forms and should not be construed as limited to the exemplary embodiments set forth herein; rather, these embodiments are provided so that this disclosure will satisfy applicable legal requirements. Like reference numerals refer to like elements throughout.

Sonar systems, such as sonar depth finders, sidescan sonars and sonar fish finders, are commonly employed by boaters, sport fishermen, search and rescue personnel, researchers, surveyors, and others. With reference to FIG. 1, a boat 10 may include a sonar system configured to create electrical pulses from a transmitter. A transducer then converts the electrical pulse into sound waves 12, which are sent into the water. In the depicted embodiment, a fan-shaped sound beam (e.g., a beam shape created from one or more rectangular transducers) is being transmitted into the water, however, as will be apparent to one of ordinary skill in the art in view of this disclosure, other sound beam configurations (e.g., conical shaped, multiple conical shaped, etc.) may be transmitted. Further information regarding different sonar transmissions is described in U.S. patent application Ser. No. 12/460,139, entitled "Downscan Imaging Sonar," filed Jul. 14, 2009, and U.S. patent application Ser. No. 12/460,093, entitled "Circular Downscan Imaging Sonar," filed Jul. 14, 2009, the entire disclosure of which are hereby incorporated by reference herein.

When the sound waves 12 strike anything of differing acoustic impedence, the sound waves 12 reflect off that object. These echos or sonar returns strike the transducer (or, in some cases, a separate receiver element), which converts the echos back into an electrical signal which is processed by a processor 23 and sent to a display (e.g., an LCD) mounted in the cabin or other convenient location in the boat. This process is often called "sounding". Since the speed of sound in water is constant (approximately 4800 feet per second in fresh water), the time lapse between the transmitted signal and the received echos can be measured and the distance to the objects determined. This process repeats itself many times per second. The results of many soundings are used to build a picture on the display of the underwater world.

For example, the sound waves 12 may bounce off the floor 14 of the body of water and reflect back to the boat, thereby indicating a depth of the water at that location. Sometimes, the floor 14 may have an uneven topography (e.g., a raised surface 16) that may reflect different depths of the water at different locations. In such a circumstance, the sound waves 12 reflect off the various floor surfaces and back to the boat 10. Since the raised surface 16 is closer to the boat 10, the sound waves 12 will reach the boat 10 faster and indicate to the sonar system that the depth is shallower at raised surface 16 than at surface 14. Additionally, objects on the floor (e.g., sunken logs, rocks, wreckage of ships, etc.) reflect the sonar beams and are detected as topographical features. Fish in the water also create their own characteristic sonar returns.

The active element in a transducer may comprise at least one man-made crystal (e.g., lead zirconate or barium titanate). A conductive coating is applied to two sides of the crystal. Wires are soldered to these coatings so the crystal can be attached to a cable which transfers the electrical energy from the transmitter to the crystal. When the frequency of the electrical signal is the same as the mechanical resonant frequency of the crystal, the crystal moves, creating sound waves at that frequency. The shape of the crystal determines both its resonant frequency and cone angle. For round crystals, the thickness determines its frequency and the diameter determines the cone angle or angle of coverage. For example at 200 kHz, a 20 degree cone angle crystal is approximately one inch in diameter, whereas an eight degree cone requires a crystal that is about two inches in diameter. Sometimes it is desirable to have coverage which is wide in one direction (x axis) but narrow in the perpendicular direction (y axis). This fan shaped beam is usually produced by a rectangular element or an elliptical element. Moreover, in some embodiments, more than one transducer is used to create increased or enhanced sound wave coverage. Likewise, in some embodiments, more than one crystal may be used to create increased or enhanced sound wave coverage.

Frequencies used by sonar devices vary but the most common ones range from 50 KHz to 800 KHz depending on application. Some sonar systems vary the frequency within each sonar pulse using "chirp" technology. These frequencies are in the ultrasonic sound spectrum and are inaudible to both humans and fish.

Transducers come in all shapes and sizes. Most transducer housings for recreational boats are made from plastic, but some thru-hull transducer housings are made from bronze. In some cases, the size and shape of the transducer housing is determined by the size of the crystal inside and the shape required to have a smooth laminar flow of water over the face of the transducer so as to not create acoustical noise which can interfere with the returned echos. Additionally, however, the type of mounting required for each watercraft may be different, as some universal mountings provide less than desirable performance. For example, a trolling motor is designed to pass close to the surface under the water. Additionally, a transom mounted transducer may hang below the hull of the boat for better coverage area and less chance of interference with the boat. Therefore, converting a typical transom mount transducer to a trolling motor mount often results in a mount that is easily damaged by underwater debris or the floor when the boat is in very shallow water.

As such, embodiments of the present invention provide systems and apparatuses for interchangeable mounting options for a sonar transducer. In some embodiments, a transducer housing is provided for mounting to a watercraft or other waterborne object (e.g., towfish, surface tow board, submersible, remote operated vehicle, autonomous underwater vehicle, etc.). In some embodiments, a transducer housing is configured for hull mounting, transom mounting, troll motor mounting, portable mounting, and thru-hull mounting, eliminating the need to exchange transducer units. Additionally, in some embodiments, no fasteners or tools are required for changing between mounting options.

With reference to the figures, systems and apparatuses for mounting a transducer housing through transom mounting, thru-hull mounting, portable mounting, and trolling motor mounting will be described herein. As will be apparent to one of ordinary skill in the art in view of this disclosure, however, such systems and apparatuses may be used for other types of mounting to a watercraft. Additionally, some embodiments of the present invention are interchangeable between each of the different types of mountings, including those mounting types described herein. Moreover, while just one transducer is shown mounted in the referenced figures, some embodiments of the present invention may incorporate more than one transducer mounting for each watercraft.

Figure 2:
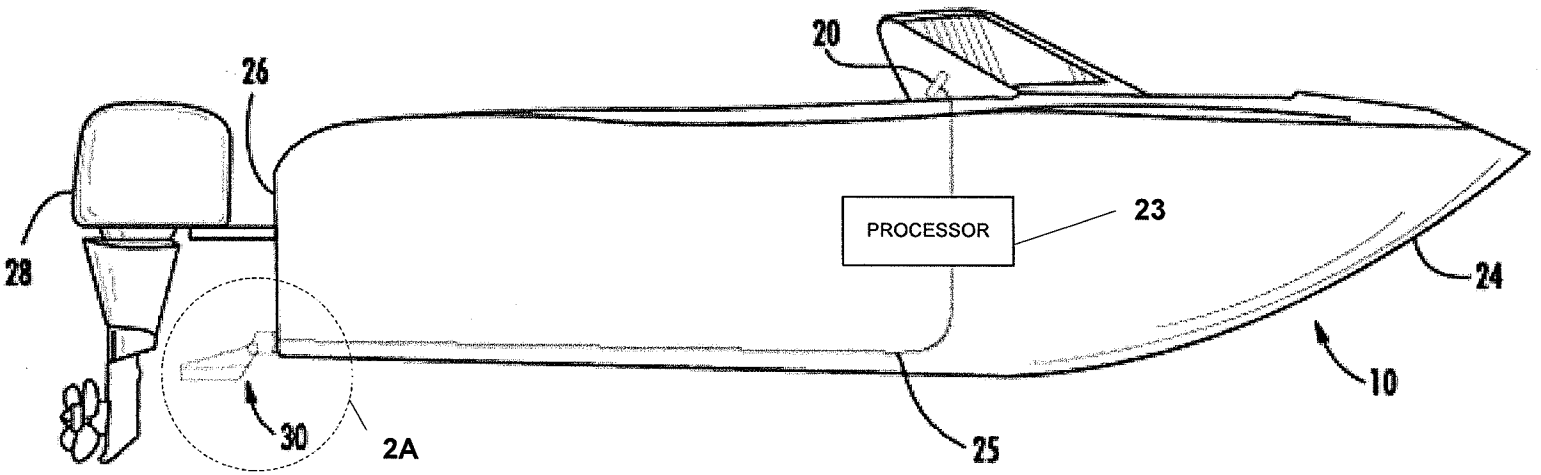
FIG. 2 illustrates a system for mounting of a transducer housing on a boat hull (e.g., at the transom), in accordance with example embodiments described herein.

FIG. 2 illustrates a system 30 for mounting a transducer to the transom of a boat 10. In the depicted embodiment, the boat 10 includes a hull 24 and transom 26. An engine 28 is mounted near the transom 26 of the boat. The transducer is preferably mounted near the bottom of the transom of the boat 10, but may be attached to the hull in other locations. In some embodiments, as described above, a cable 25 may connect the transducer to a sonar signal processor 23, which in turn is connected to a sonar head 20. The sonar head 20 may include a display that provides an indication (e.g., depth, fish location, bottom topography, etc.) to a user/driver, as well as a user interface.

Figure 2A:
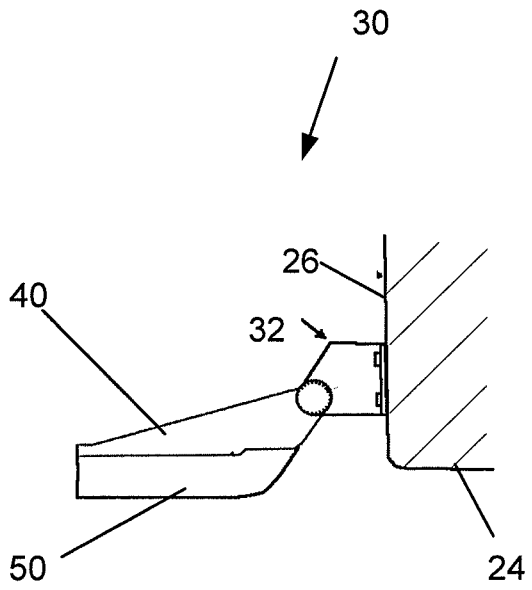
FIG. 2A shows a detail view of the system for transom mounting shown in FIG. 2, in accordance with example embodiments described herein.

FIG. 2A represents a detailed view of the system 30 for mounting a transducer to the transom of a boat. In the depicted embodiment, a transom mounting bracket 32 attaches to the transom 26 of the boat 10. For example, the transom mounting bracket may be fastened to the transom of the boat, such as with screws, adhesive, or the like. In some embodiments, the cable 25 may be fed through the hull of the boat so as to connect to the sonar system on the boat, as noted above.

Figure 3:
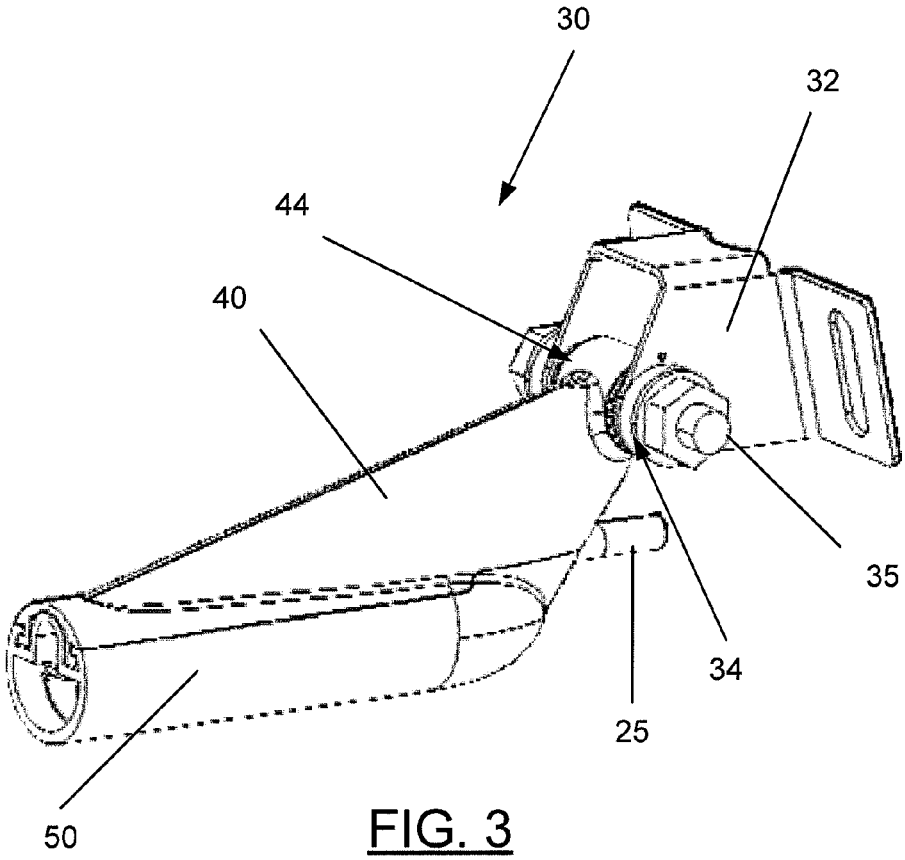
FIG. 3 shows a perspective view of the system for transom mounting shown in FIG. 2, in accordance with example embodiments described herein.
Figure 4:
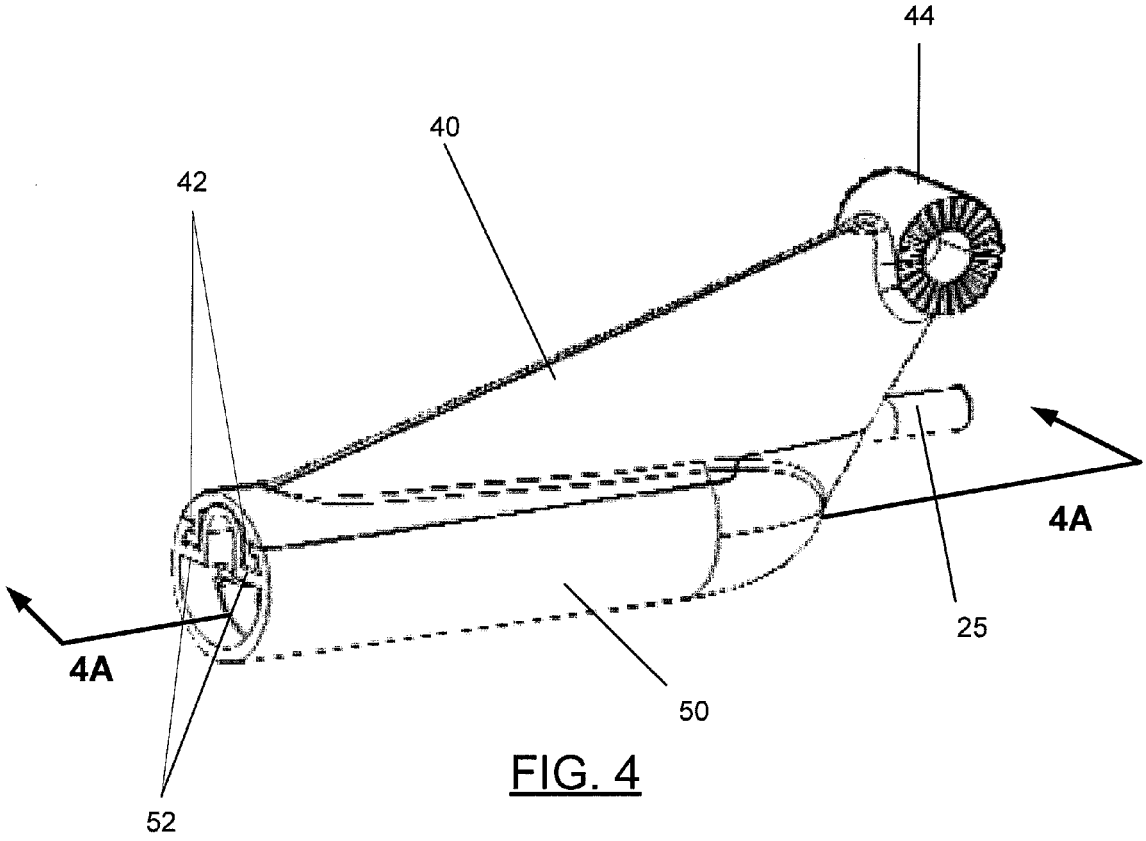
FIG. 4 shows a perspective view of the transducer housing and transom mount adapter shown in FIG. 3, in accordance with example embodiments described herein.
Figure 4A:
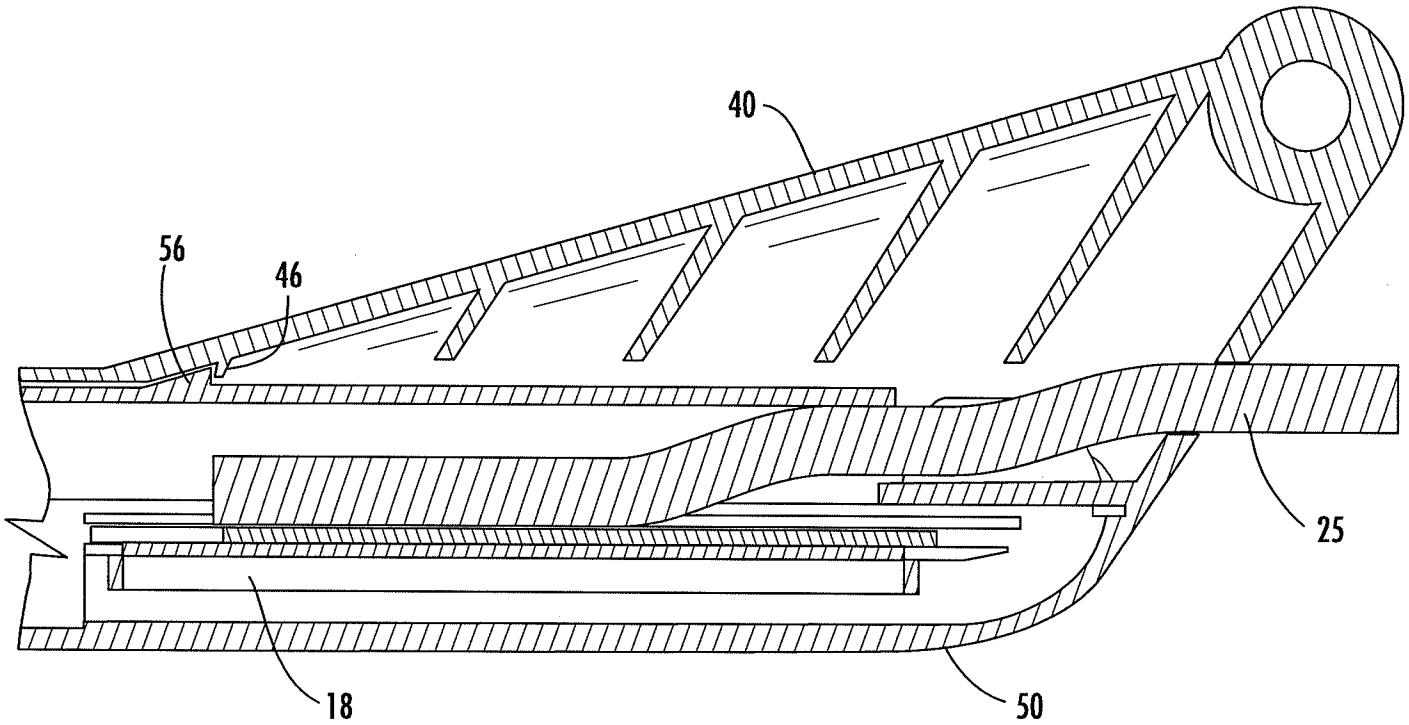
FIG. 4A shows a cross-sectional view of the transducer housing and transom mount adapter along line 4A in FIG. 4, in accordance with example embodiments described herein.

With reference to FIG. 3, the transom mounting bracket 32 may attach to a transom mount adapter 40. In some embodiments, the transom mounting bracket 32 comprises a transom mounting attachment feature 34 that is configured to attach to a corresponding attachment feature 44 on the transom mount adapter 40. In the depicted embodiment, a screw 35 securely fastens the transom mounting attachment feature 34 to the transom mount adapter attachment feature 44. In some embodiments, the transom mount adapter 40 (and transducer housing 50) may be rotatably attached to the transom mounting bracket 32.

The transducer housing 50 may be configured to engage with the transom mount adapter 40. In some embodiments, the transducer housing 50 may be configured to removably engage with the transom mount adapter 40. As shown in FIGS. 4, 4A, 5, 5A, and 6, in some example embodiments, the transducer housing 50 may be configured to slidably engage the transom mount adapter 40. However, the transducer housing 50 may be configured to engage the transom mount adapter 40 in other ways, such as by clamping, fastening, adhering, or other engagement means.

Figure 7:
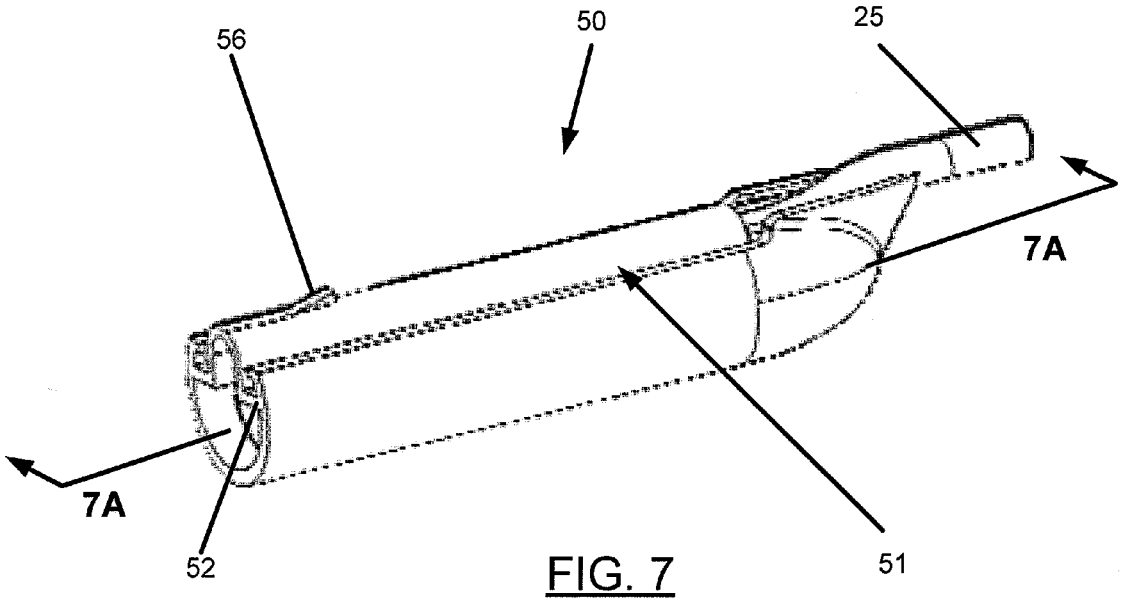
FIG. 7 shows a perspective view of the transducer housing shown in FIG. 4, in accordance with example embodiments described herein.
Figure 7A:
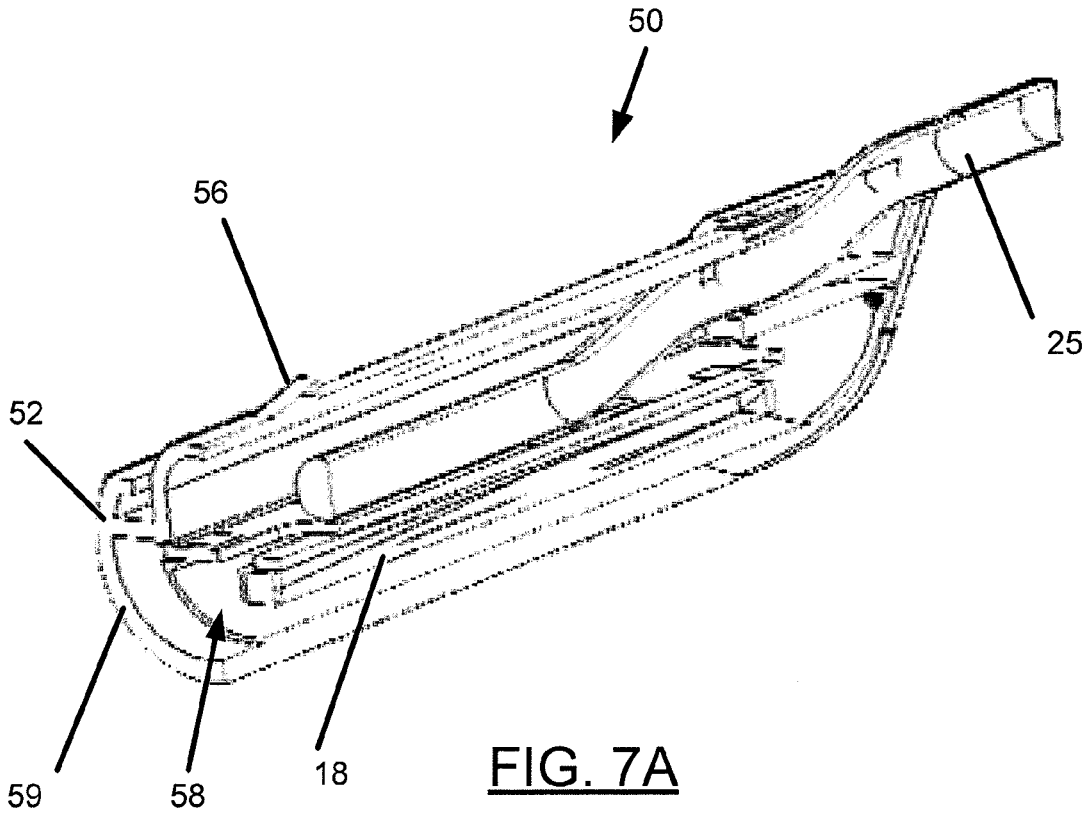
FIG. 7A shows a cross-sectional view of the transducer housing along line 7A in FIG. 7, in accordance with example embodiments described herein.

The transducer housing 50, as shown in FIGS. 7 and 7A, may be configured to hold at least one transducer. In the depicted embodiment, the transducer housing 50 is configured with a space 58 for the transducer/crystal 18. As noted above, however, in some embodiments, the transducer housing 50 may be configured to house more than one transducer/crystal. Moreover, in some embodiments, the transducer housing 50 may be configured to house different types and/or shapes of crystals (e.g., cylindrical, rectangular, etc.), or a combination of different types or shapes. For example, the transducer housing 50 may be configured to house multiple types of transducers, each of different configurations. Additionally or alternatively, in some embodiments, the transducer/crystal 18 may be separable from the transducer housing 50.

In some embodiments, the transducer housing 50 may be configured to house at least a portion of the cable 25. In the depicted embodiment, the transducer housing 50 may be configured such that the cable 25 may pass out the rear of the transducer housing 50. Feeding the cable 25 out of the rear of the transducer housing 50 may enable the cable 25 to be maneuvered or positioned easily and out of the way depending on the mounting option used for the transducer housing 50.

Figure 5:
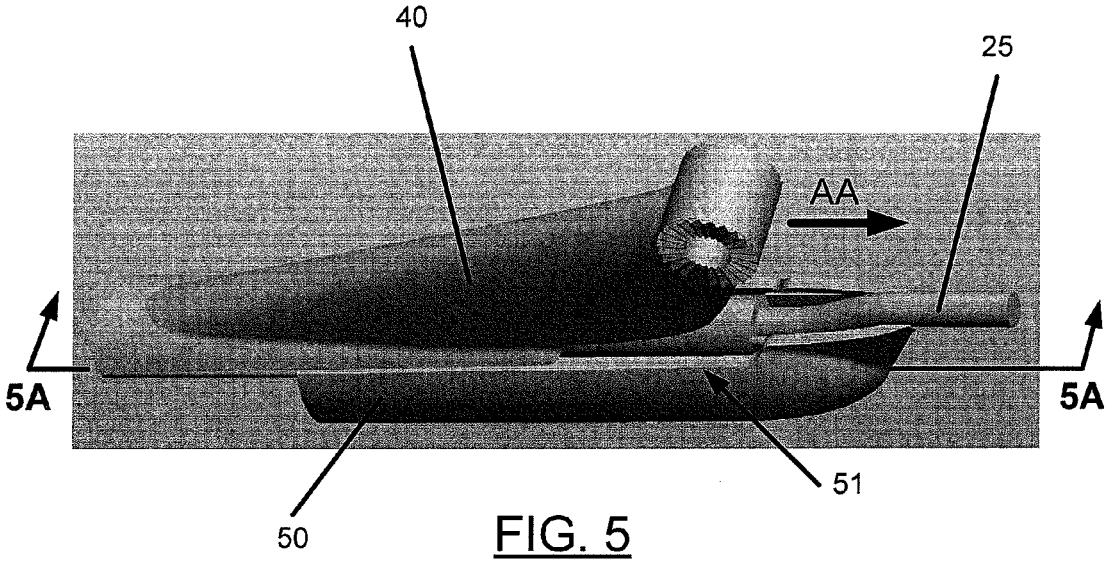
FIG. 5 shows a perspective view of the transducer housing and transom mount adapter shown in FIG. 4, wherein the transom mount adapter is partially disengaged from the transducer housing, in accordance with example embodiments described herein.

Returning now to an example of mounting the transducer housing to the transom of a boat, the transducer housing 50 may comprise an upper engagement surface 51 (shown in FIGS. 5 and 7). In some embodiments, the upper engagement surface 51 may be configured to adjacently engage the transom mount adapter 40.

Figure 5A:
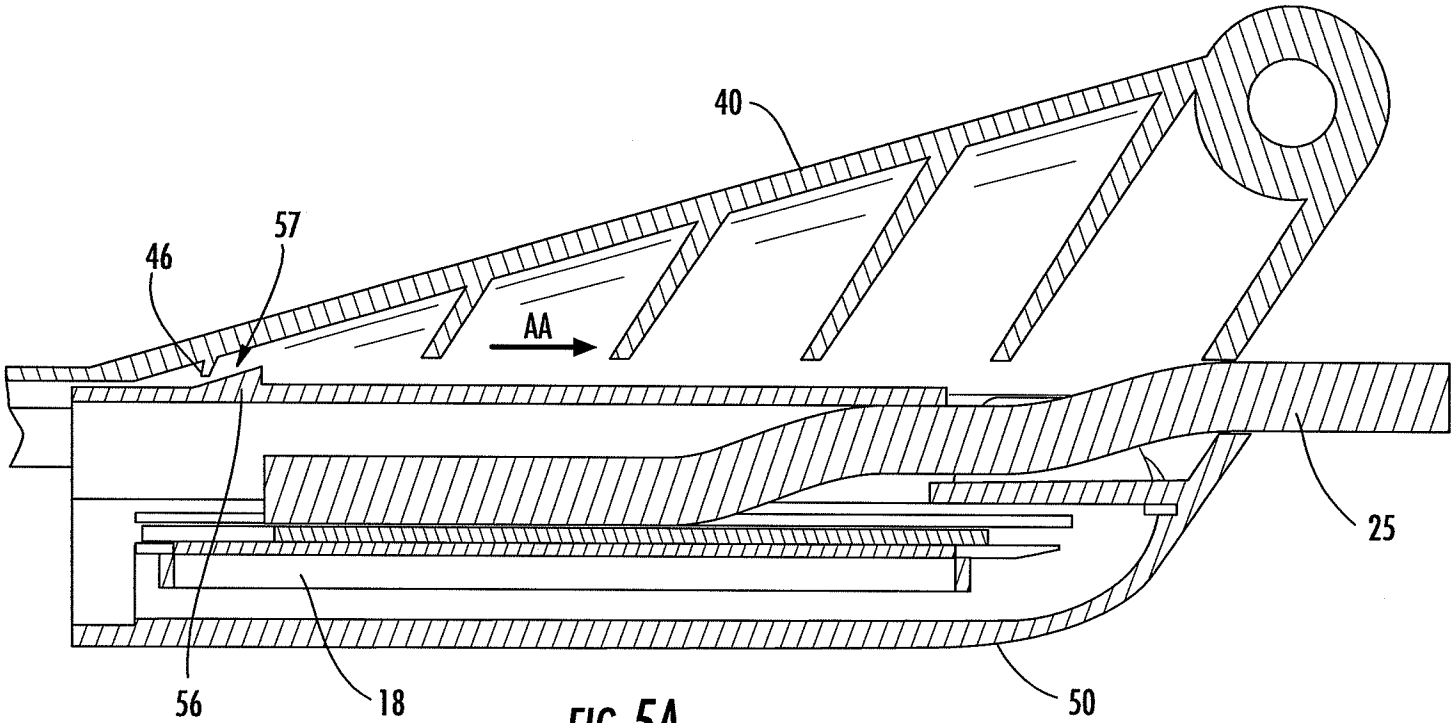
FIG. 5A shows a cross-sectional view of the transducer housing and transom mount adapter along line 5A in FIG. 5, in accordance with example embodiments described herein.
Figure 6:
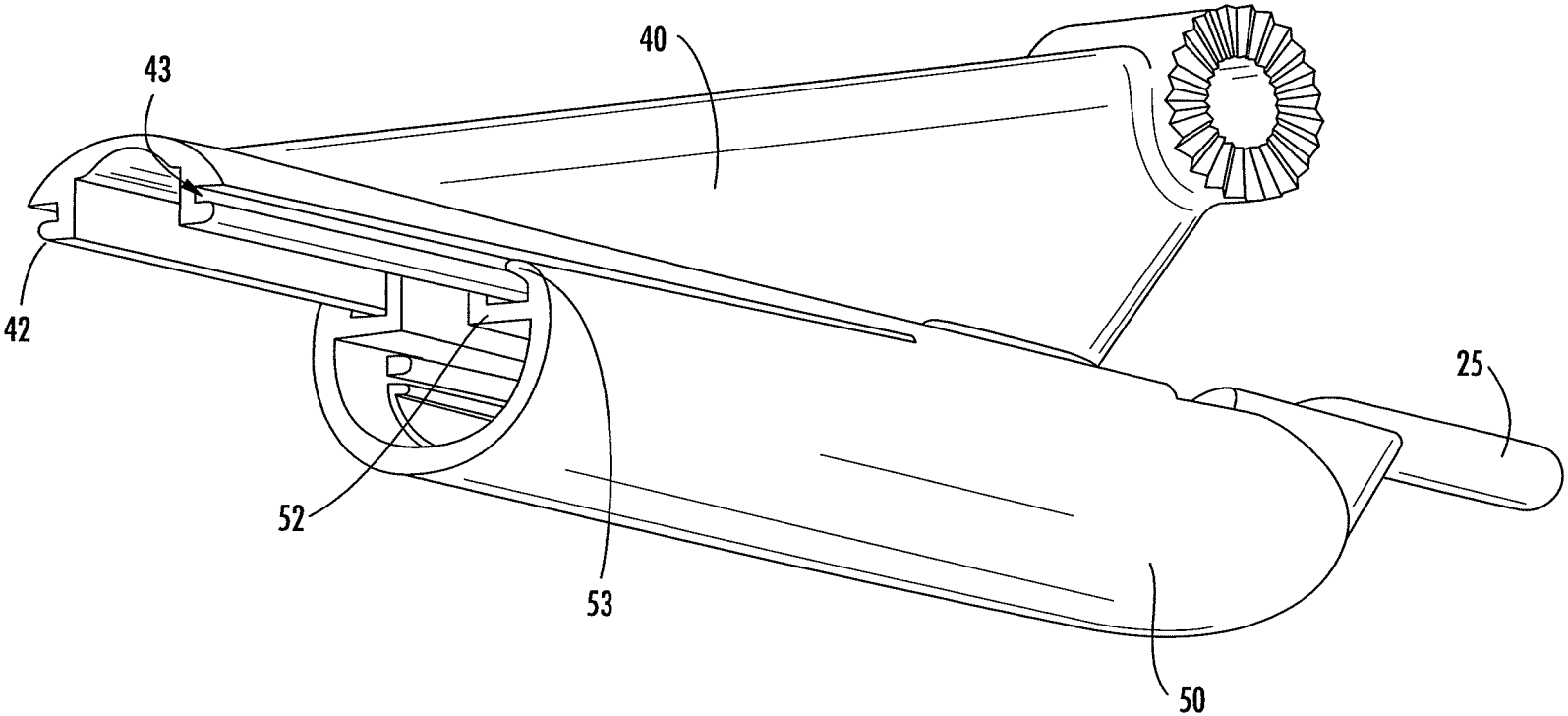
FIG. 6 shows a perspective bottom view of the transducer housing and transom mount adapter shown in FIG. 5, in accordance with example embodiments described herein.

In an example embodiment, the transom mount adapter 40 may slidingly engage the transducer housing 50. For example, the upper engagement surface 51 may comprise an engagement feature 52 that corresponds to engagement features 42 on the transom mount adapter 40. The corresponding engagement features 42, 52 are configured to enable the transom mount adapter 40 to be slide into engagement with the transducer housing 50. For example, FIG. 6 illustrates that a slide flange 53 on the transducer housing 50 may fit into a slide flange receiving feature 43 on the transom mount adapter 40. In such a manner, the transom mount adapter 40 can be slide onto and into adjacent engagement with the transducer housing 50 (e.g., FIGS. 5, 5A, and 6 transition to FIGS. 4 and 4A, such as along line AA in FIG. 5). Though specific features are illustrated in the example embodiments of FIGS. 4, 4A, 5, 5A, and 6, other engagement means may be used for engagement of the transom mount adapter 40 to the transducer housing 50.

Additionally, in some embodiments, the transducer housing 50 may be configured to attach to the transom mount adapter 40. In some embodiments, the transducer housing 50 may be configured to removably attach to the transom mount adapter 40. In the depicted embodiments of FIGS. 4, 4A, 5, and 5A, the transducer housing 50 is configured to attach to the transom mount adapter 40 through a snap-fit engagement. For example, the transducer housing 50 may comprise a protrusion 56 configured to securely engage a locking feature 46 on the transom mount adapter 40 (shown attached in FIG. 4A) to prevent the transom mount adapter 40 from easily sliding out of engagement with the transducer housing 50. Moreover, in some embodiments, as shown in FIG. 5A, the protrusion 56 may comprise a tapered slope 57, such that the locking feature 46 on the transom mount adapter 40 may slide up the slope 57 and "snap" into position as the transom mount adapter 40 is engaged with the transducer housing 50, such as along line AA.

The transom mount adapter 40 may also be removed from the transducer housing 50, such as to provide for a different mounting option for the transducer housing 50. In some embodiments, the at least one upper engagement surface of the transducer housing 50 may be configured to releasably engage the transom mount adapter 40 to allow the transom mount adapter 40 to be detached and removed without damaging or altering the transducer housing 50. For example, in some embodiments, to remove engagement with the transom mount adapter 40, the transom mount adapter 40 may be slide in the opposite direction of line AA. Additionally or alternatively, the transom mount adapter 40 may be lifted or slightly maneuvered to dislodge attachment of the protrusion 56 to the locking feature 46. In such a manner, snap-fit engagement may provide a means for removable attachment of the transducer housing 50 to the transom mount adapter 40. Moreover, in some embodiments, such engagement may be achieved without fasteners or adhesive bonding, and without tools.

Figure 8:
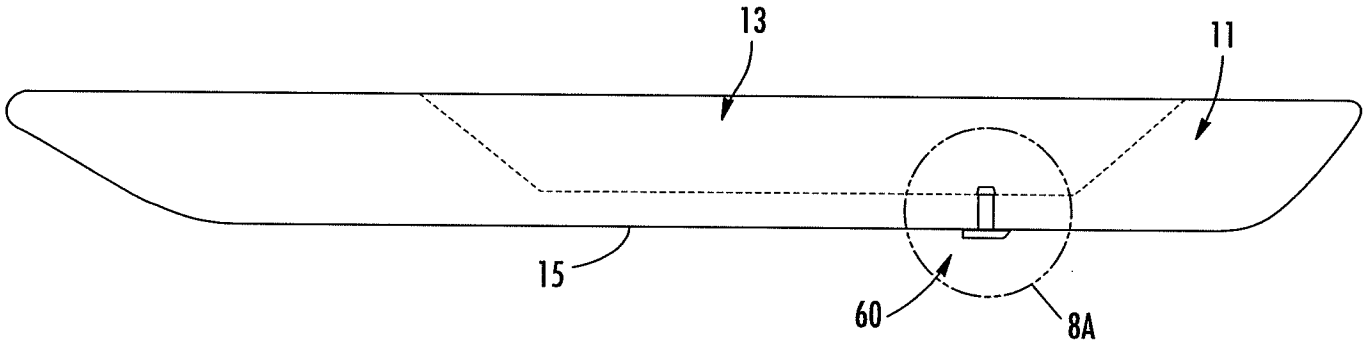
FIG. 8 illustrates a system for mounting a transducer housing to a kayak, in accordance with example embodiments described herein.

FIG. 8 illustrates a system 60 for mounting a transducer through the hull of a kayak 11. In the depicted embodiment, the transducer is mounted through a scupper hole in the hull 15 of the kayak 11. For example, kayaks often have at least one scupper hole for draining of water that may be inside the kayak, such as from the sitting portion 13 of the kayak 11. Therefore, a mounting system (e.g., the thru-hull mounting system 60) may be positioned through the scupper hole to mount a sonar transducer to a kayak. Since kayaks often do not have as strict of requirements for keeping water out, in some embodiments, sealing elements (e.g., washers, adhesive, caulking, etc,) may not be necessary for the mounting system.

Figure 8A:
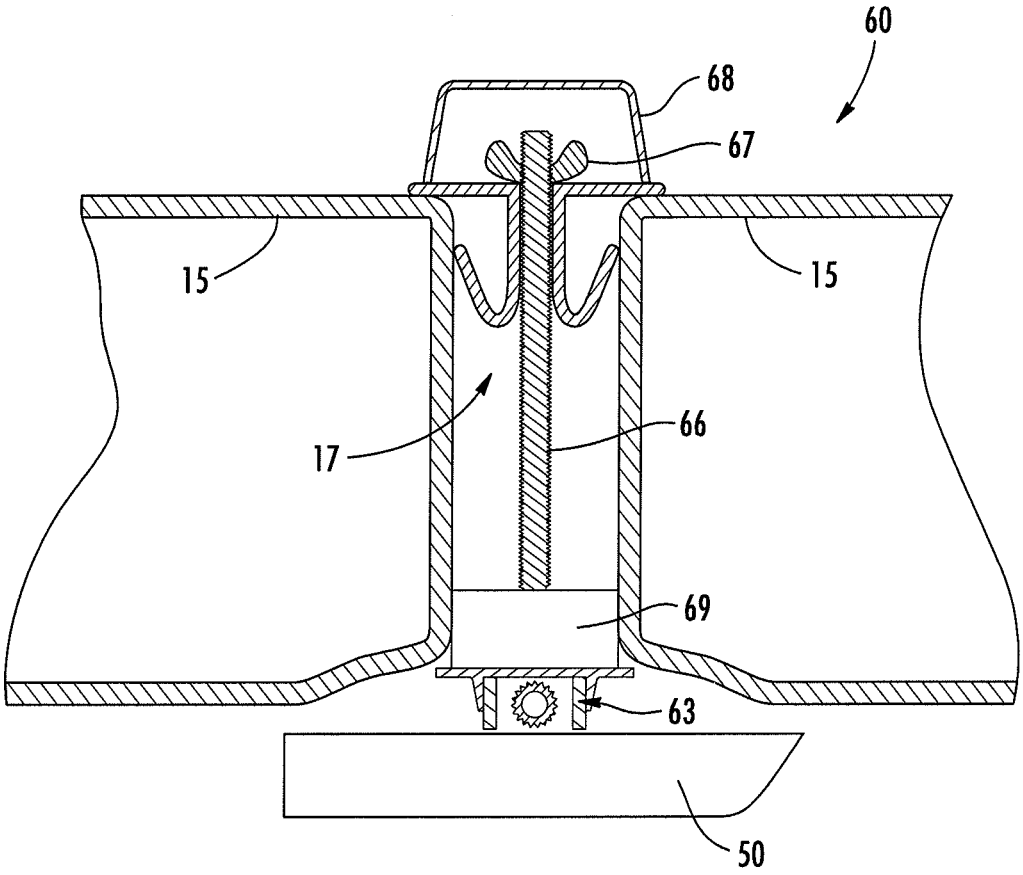
FIG. 8A shows a detail view of the system for mounting the transducer housing to the kayak shown in FIG. 8, in accordance with example embodiments described herein.

FIG. 8A represents a detailed view of the system 60 for mounting a transducer through the scupper hole 17 of the kayak 11. In the depicted embodiment, a screw 66 passes through the scupper hole 17 of the hull 15. The screw 66 is attached to a kayak mounting adapter 63. A washer 69 may also be positioned between the kayak mounting adapter 63 and the hull of the boat to provide sealing and to maintain the position of the screw 66 inside the scupper hole 17. Additionally, in some embodiments, a nut 67 may tighten onto the screw 66 to fasten the kayak mounting adapter 63 to the kayak 11. In some embodiments, a protective cap 68 may be positioned around the nut 67 and/or screw 66 for protection and/or aesthetic purposes.

Figure 8B:
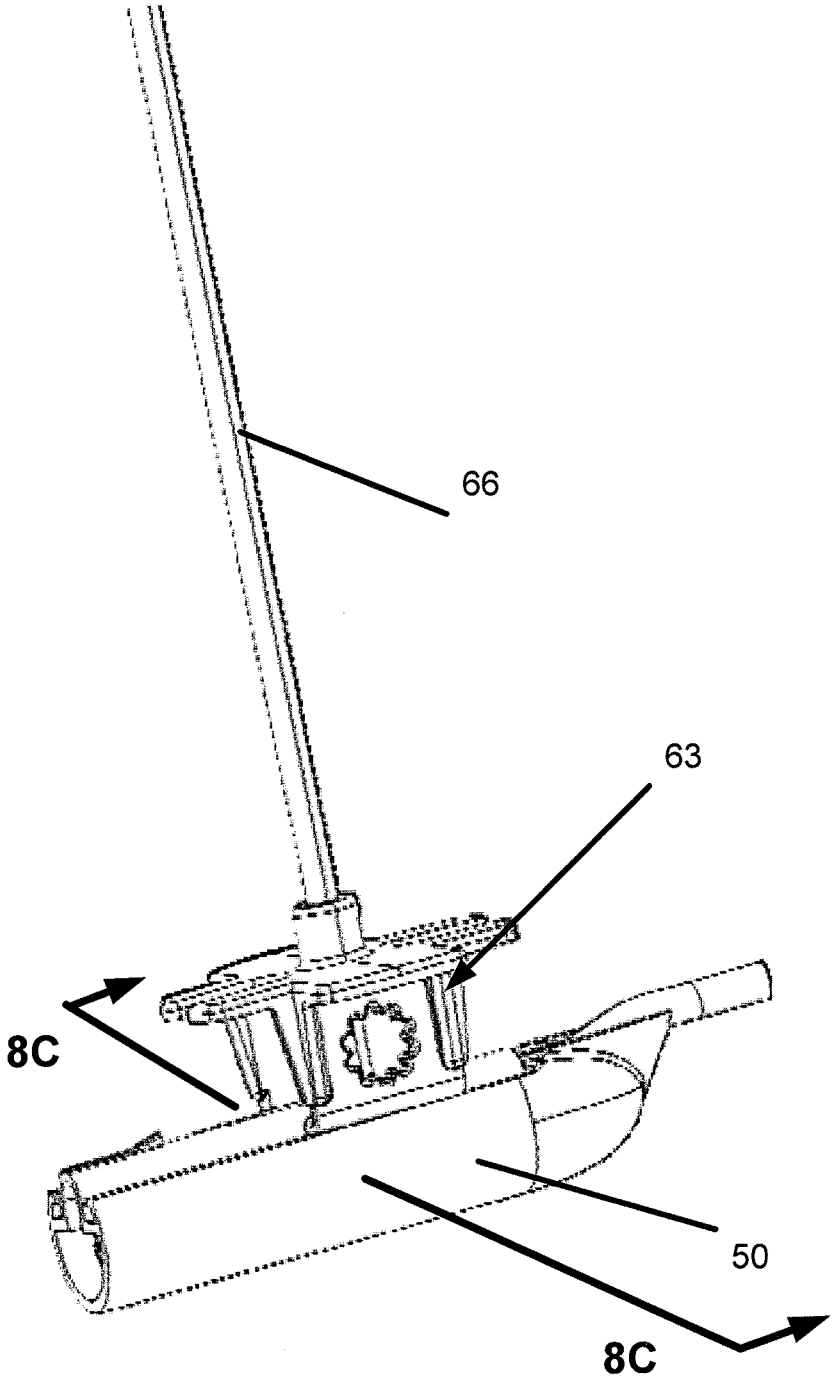
FIG. 8B shows a perspective view of a portion of the system for mounting the transducer housing to the kayak shown in FIG. 8, in accordance with example embodiments described herein.
Figure 8C:
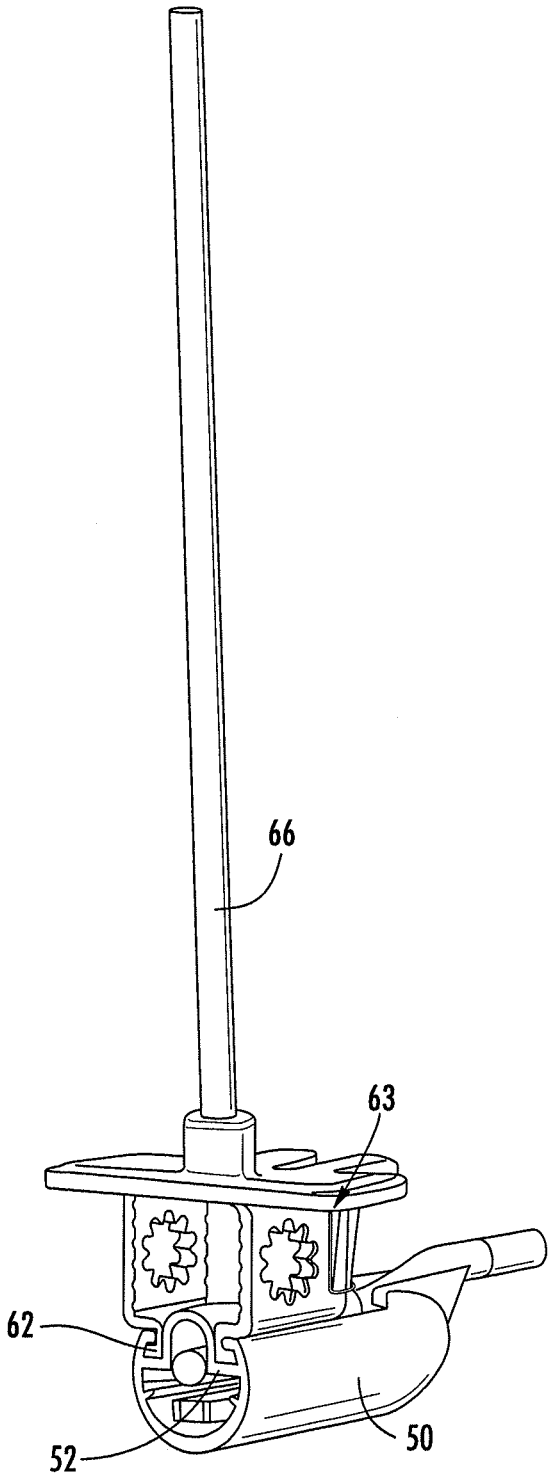
FIG. 8C shows a cross-sectional view of the transducer housing and scupper mount adapter along line 8C in FIG. 8B, in accordance with example embodiments described herein.

With further reference to FIGS. 8B and 8C, the kayak mounting adapter 63 may comprise engagement features 62 that correspond to and are configured to engage with the engagement features 52 of the transducer housing 50. Thus, in some embodiments, the kayak mounting adapter 63 is configured to slidingly engage with the transducer housing 50. In some embodiments, other locking features may be employed to attach the kayak mounting adapter 63 to the transducer housing 50 (e.g., snap-fit engagement, etc.).

Figure 9:
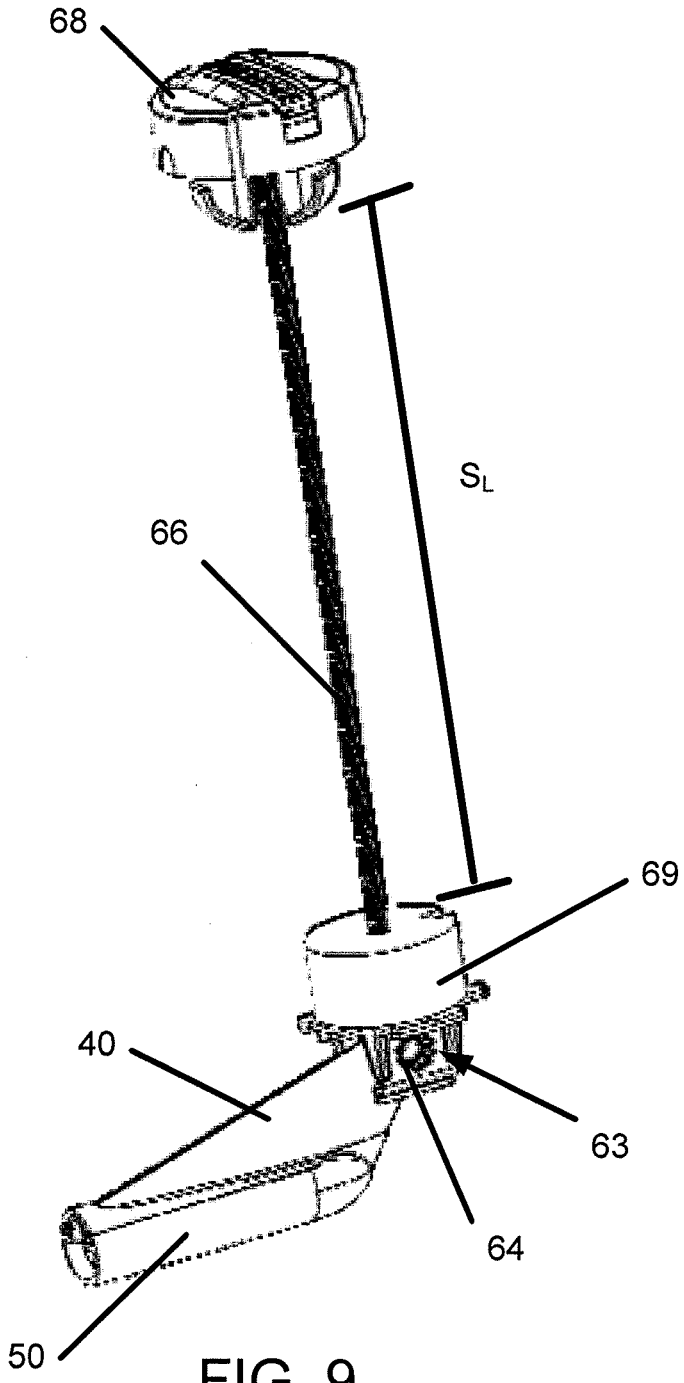
FIG. 9 shows a detail view of another example of a system for mounting the transducer housing to the kayak shown in FIG. 8, in accordance with example embodiments described herein.

Some kayaks, however, may require additional clearance for the transducer housing 50 (and transducer) due to inconsistencies in the hull 15 that may cause interference with the transducer. As such, additional mounting features may be employed to lower the transducer further below the hull 15. For example, in some embodiments, the kayak mounting adapter 63 may comprise an attachment feature 64 (shown in FIG. 9) configured to attach to an adapter (e.g., the transom mount adapter 40). The adapter may be engaged with the transducer housing 50 such that the transducer housing 50 (and transducer) becomes mounted to the kayak. In the depicted embodiment of FIG. 9, the screw 66 may pass through the scupper hole 17 of the hull 15. For example, the screw 66 may pass through a length ($S_L$) of the hull of the kayak. In such a manner, the same transom mount adapter 40, used for transom mounting to a boat, may also be used for mounting a transducer to a kayak. Such an embodiment illustrates an example system of interchangeable mounting options for the transducer housing.

Figure 10:
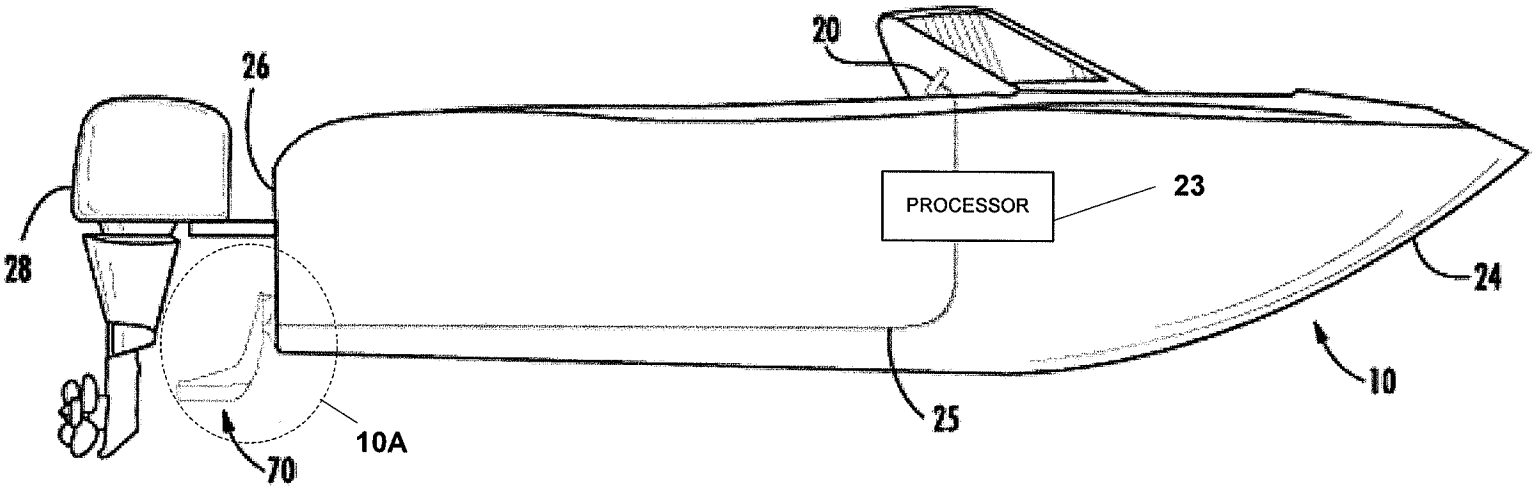
FIG. 10 illustrates a system for portable mounting of a transducer housing on a boat, in accordance with example embodiments described herein.

FIG. 10 illustrates a system 70 for portable mounting of a transducer to the transom of a boat 10. In the depicted embodiment, the transducer is mounted with a suction cup near the bottom of the transom of the boat 10. In some embodiments, as described above, a cable 25 may connect the transducer to a sonar head 20 and/or processor 23.

Figure 10A:
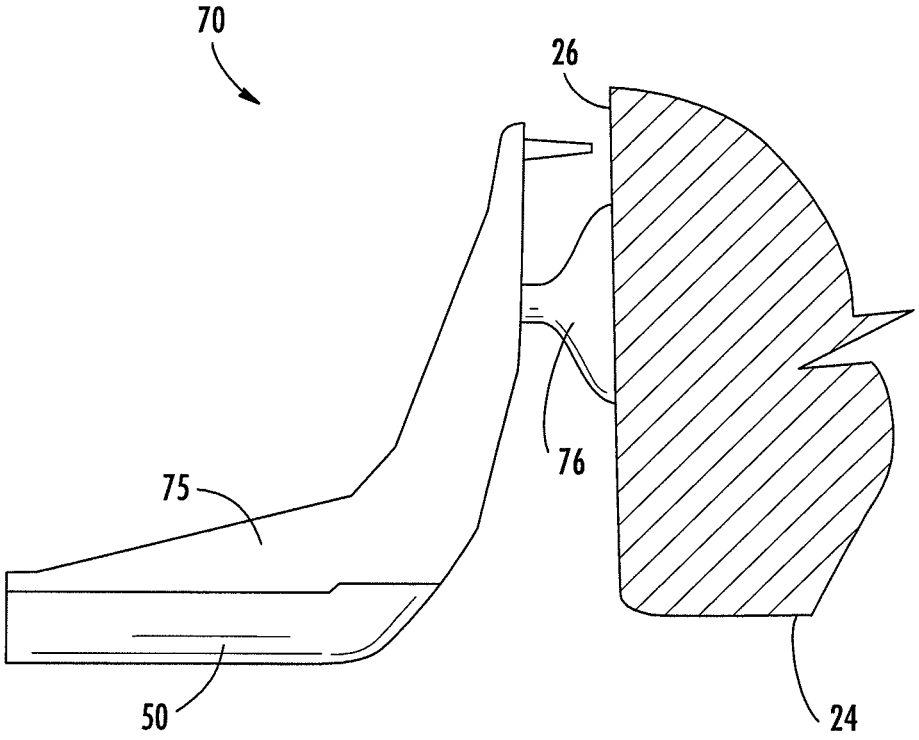
FIG. 10A shows a detail view of the system for portable mounting shown in FIG. 10, in accordance with example embodiments described herein.

FIG. 10A represents a detailed view of the system 70 for portable mounting of a transducer to the transom of a boat. In the depicted embodiment, a portable mounting adapter 75 comprises a suction cup 76, which attaches to the transom 26 of the boat 10 (e.g., through suction or pressure mounting). In other embodiments, the portable mount adapter 75 may comprise more than one suction cup or other attachment means that allow for easy detachment and mobility.

Figure 11:
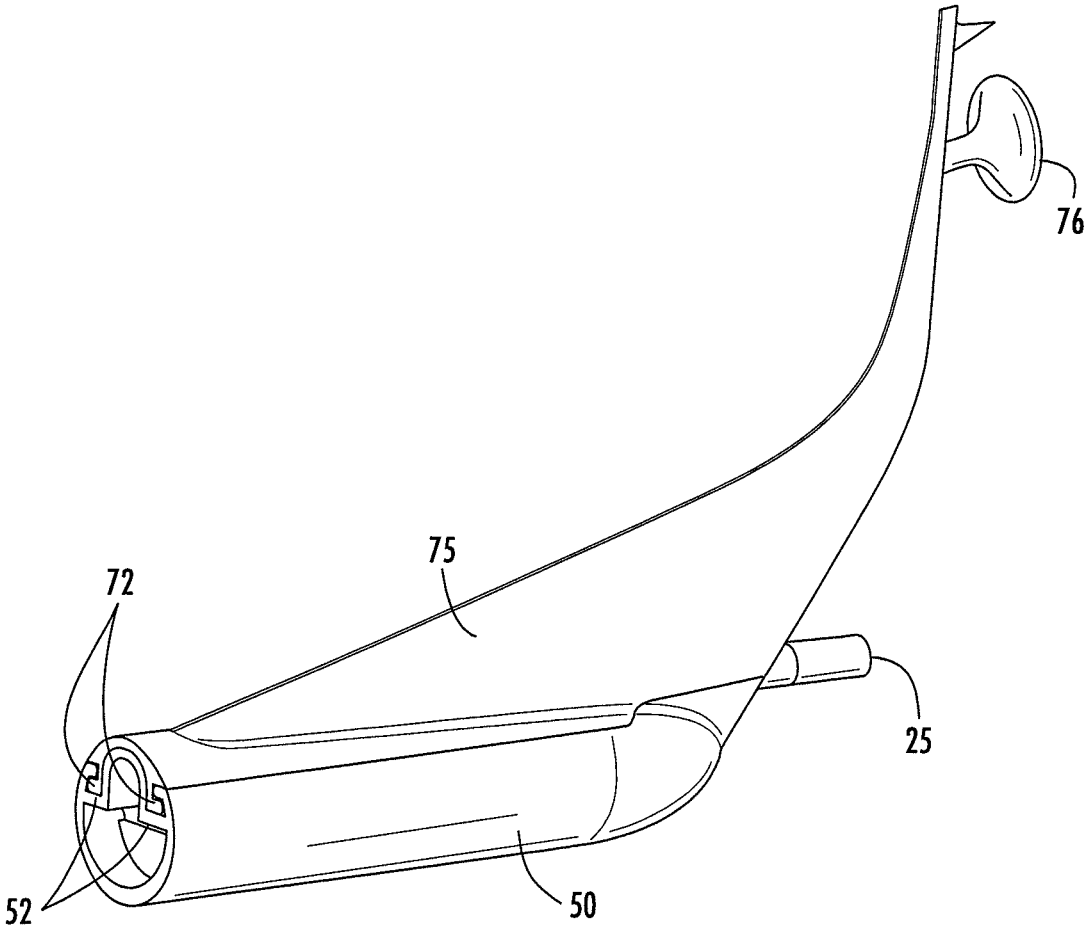
FIG. 11 shows a perspective view of the transducer housing and portable mount adapter shown in FIG. 10, in accordance with example embodiments described herein.

With reference to FIG. 11, the portable mount adapter 75 may be engaged with the transducer housing 50 in a similar manner to that of the transom mount adapter 40 described above. For example, the portable mount adapter 75 may comprise engagement features 72 that correspond to engagement features 52 on the transducer housing 50. Moreover, the portable mount adapter 75 may comprise other features that enable slidable and/or removable engagement with the transducer housing 50 (e.g., a slide flange receiving feature similar to the slide flange receiving feature 43 of the transom mount adapter).

Likewise, in some embodiments, the portable mount adapter 75 may be configured to attach to the transducer housing 50, such as through snap-fit engagement. For example, the portable mount adapter 75 may comprise a locking feature (similar to the locking feature 46 of the transom mount adapter 40) that corresponds to and engages with the protrusion 56 of the transducer housing 50. As such, in some embodiments, the portable mount adapter 75 may slide onto and snap into attachment with the transducer housing 50. Therefore, example embodiments for portable mounting illustrate another example of the interchangeable mounting options of embodiments of the present invention.

Figure 12:
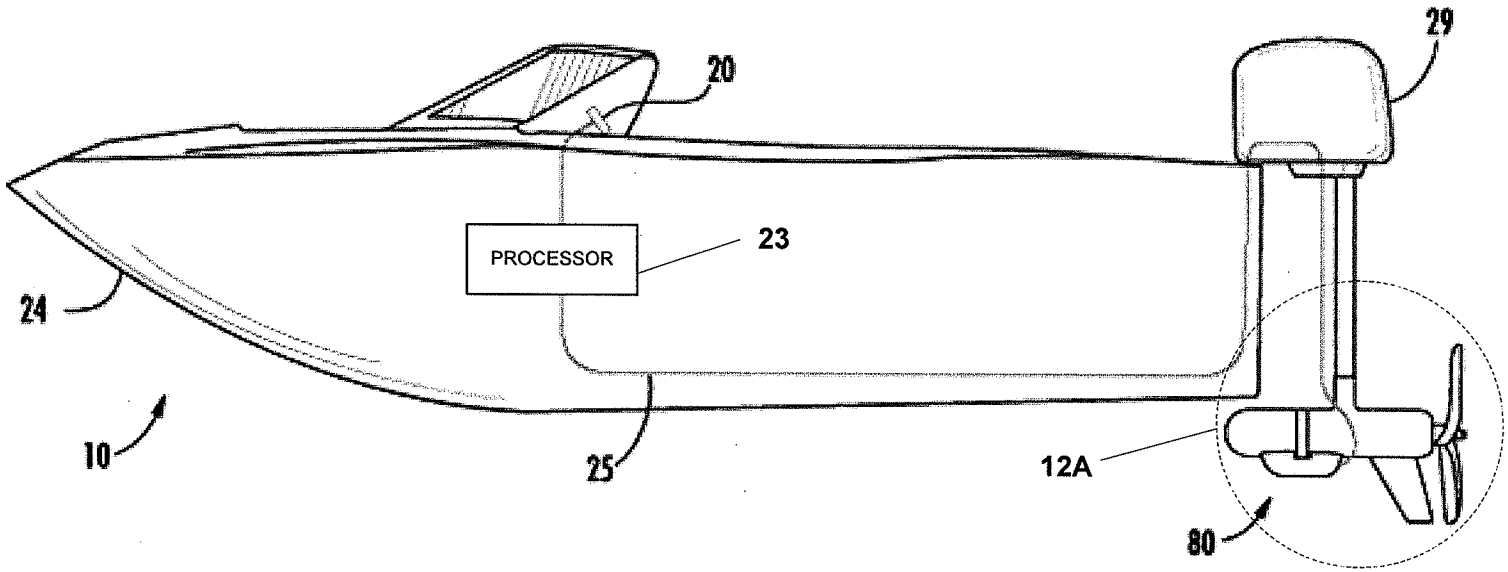
FIG. 12 illustrates a system for mounting a transducer housing to a trolling motor, in accordance with example embodiments described herein.

FIG. 12 illustrates a system 80 for mounting of a transducer to a trolling motor. In the depicted embodiment, the transducer is mounted directly to a trolling motor 29 attached to a boat 10. Trolling motors often extend below the hull 24 of the boat 10. Also, trolling often occurs in shallow waters and, thus, as noted above, transducers mounted to the housing of a trolling motor may be more likely to encounter objects (e.g., rocks) or the surface below the water.

Figure 12A:
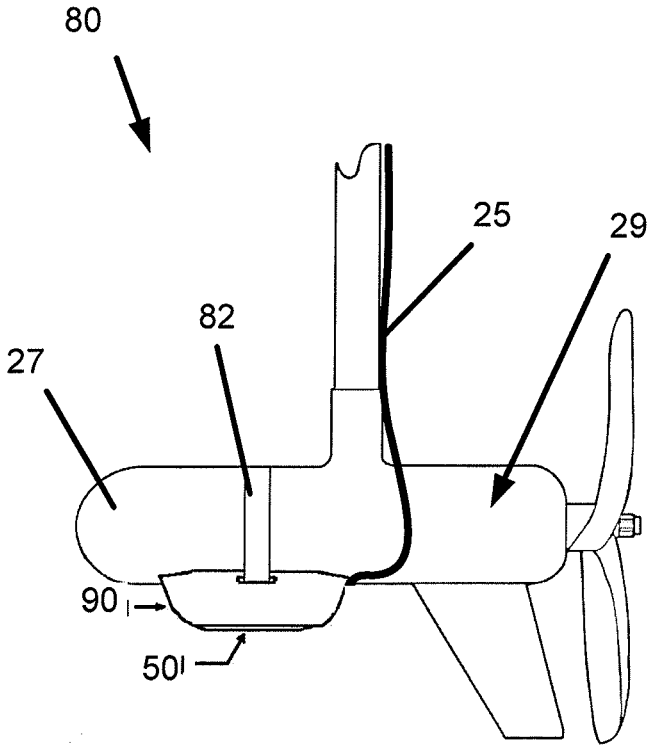
FIG. 12A shows a detail view of the system for mounting a transducer housing to a trolling motor shown in FIG. 12, in accordance with example embodiments described herein.

Similar to embodiments described above, a cable 25 may connect the transducer to a sonar display 20 or sonar return processor 23. As shown in FIGS. 12 and 12A, the cable 25 may follow the housing of the trolling motor 29 and feed into the boat 10 and to the sonar head 20.

FIG. 12A represents a detailed view of the system 80 for mounting of a transducer to a trolling motor. In the depicted embodiment, a trolling motor mount adapter 90 contains at least a portion of the transducer housing 50. The trolling motor mount adapter 90 is attached to the trolling motor 29 via a hose clamp (or strap) that is secured around a cylindrical housing 27 of the trolling motor 29.

Figure 13:
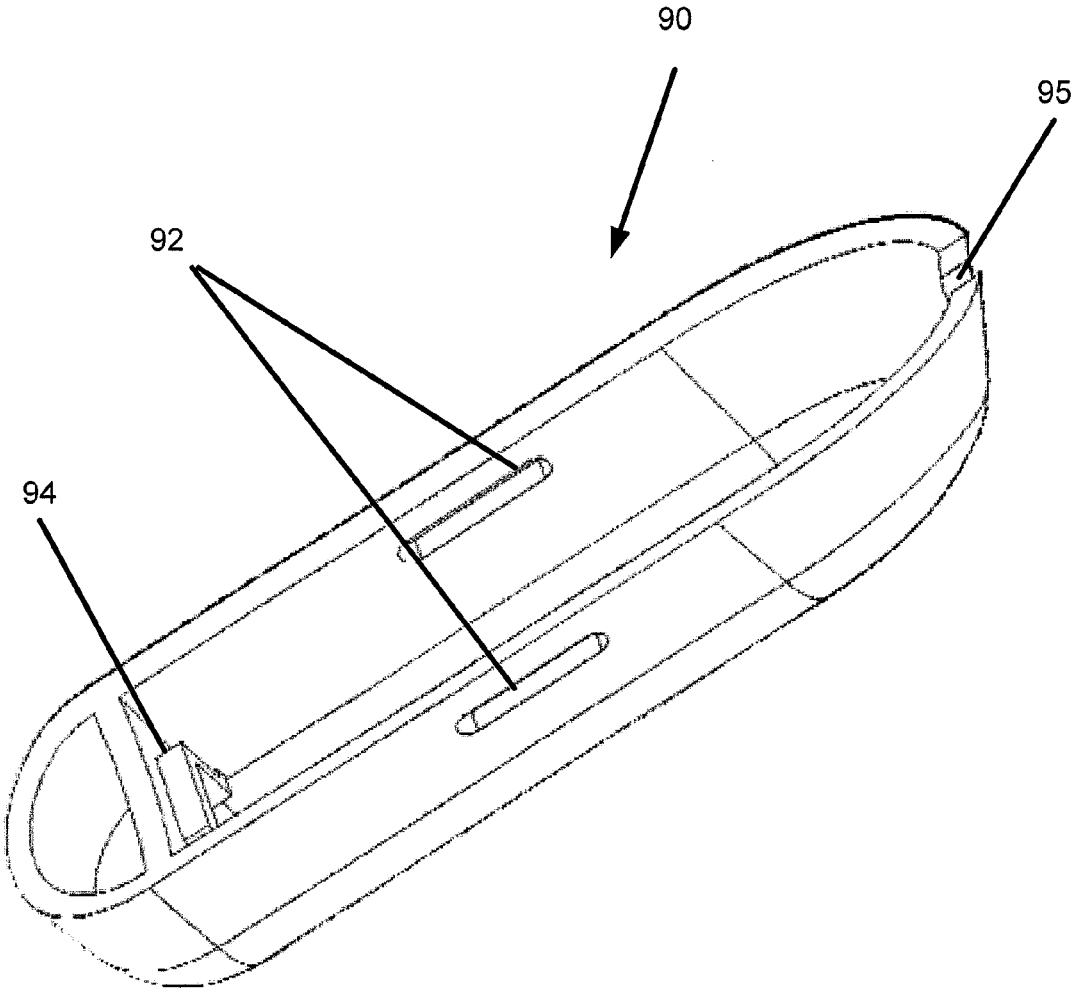
FIG. 13 shows a perspective view of the trolling motor mount adapter shown in FIG. 12A, in accordance with example embodiments described herein.
Figure 13A:
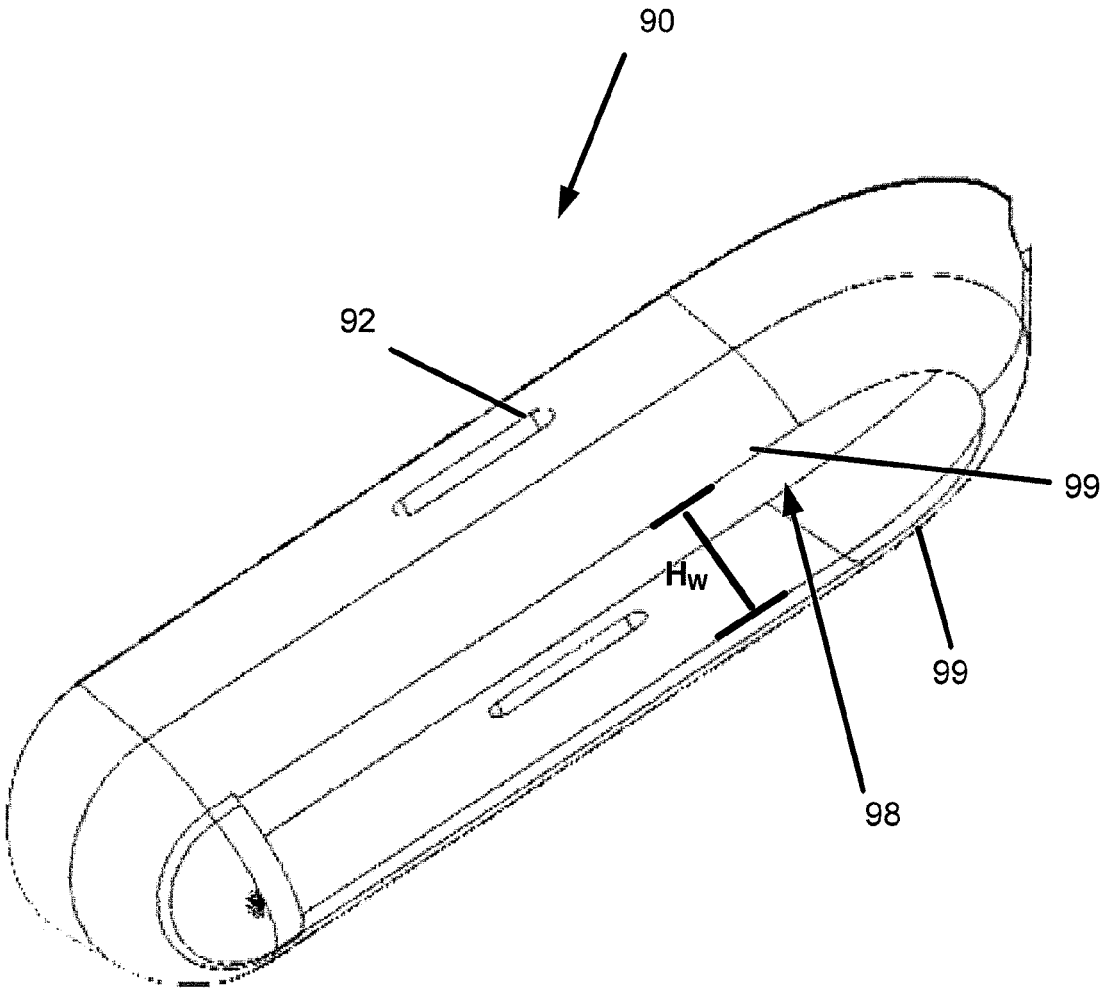
FIG. 13A shows a perspective bottom view of the trolling motor mount adapter shown in FIG. 13, in accordance with example embodiments described herein.
Figure 14:
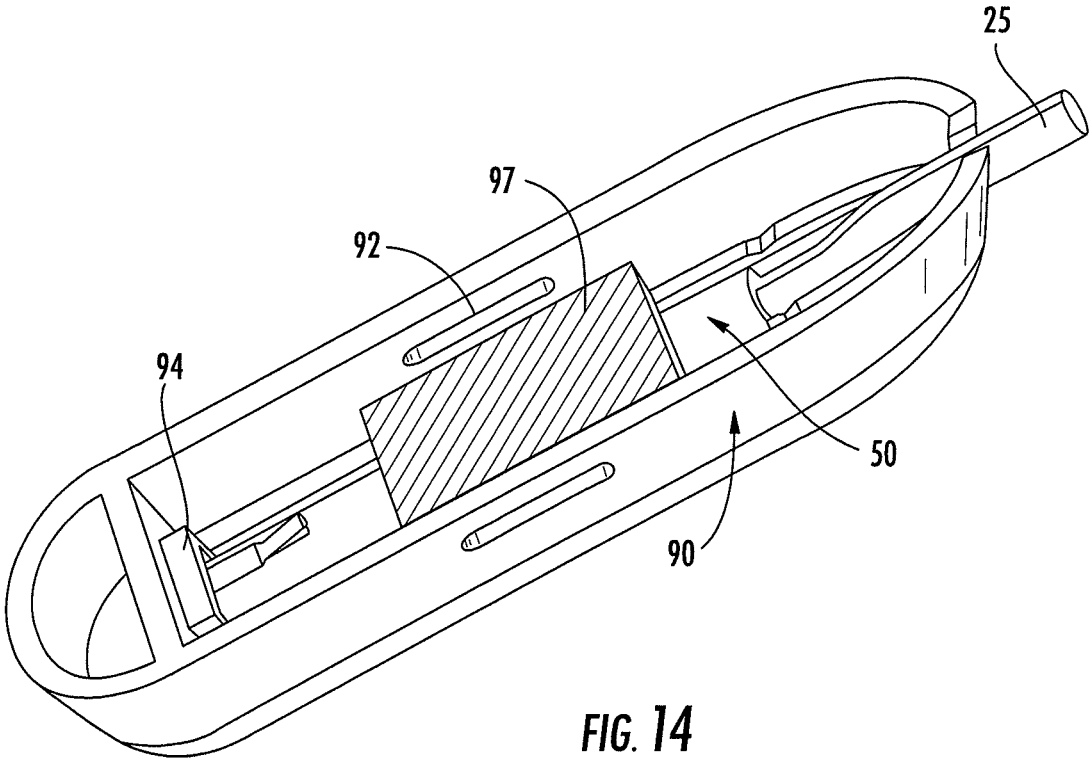
FIG. 14 shows a perspective view of the transducer housing and trolling motor mount adapter shown in FIG. 12A, in accordance with example embodiments described herein.
Figure 14A:
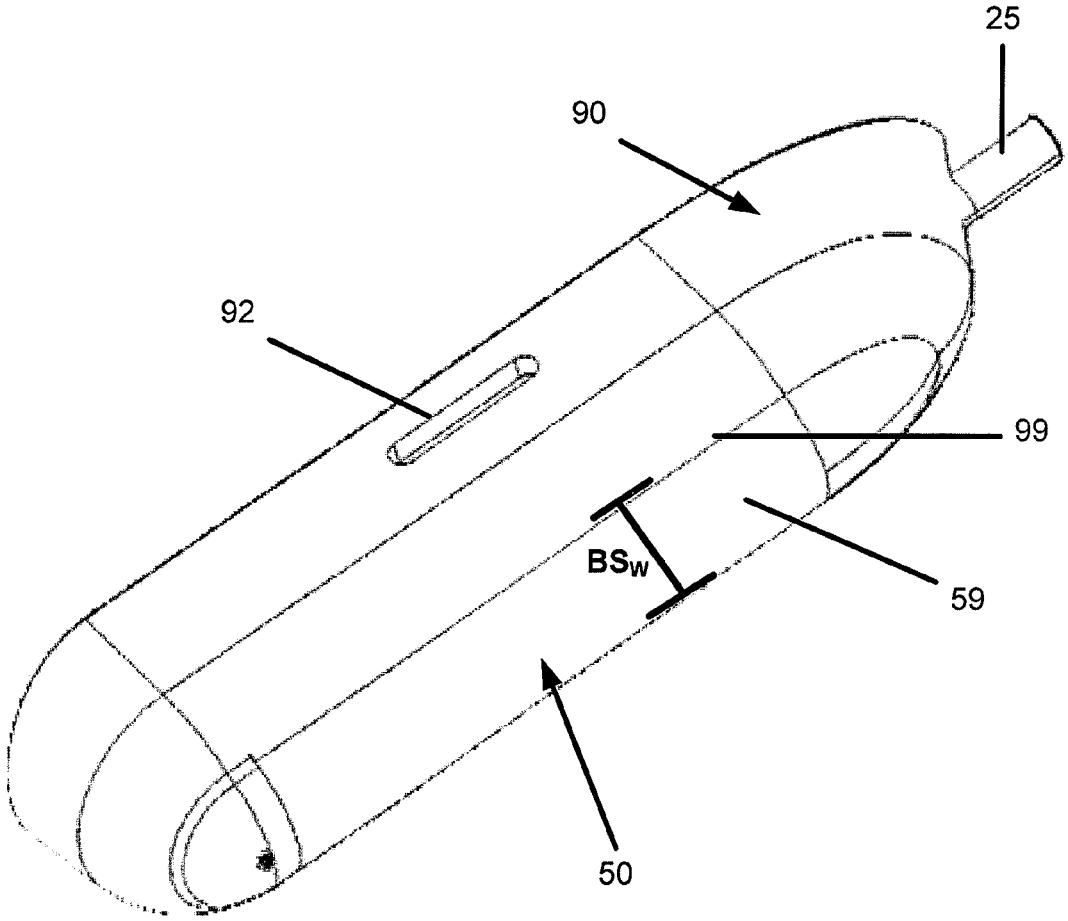
FIG. 14A shows a perspective bottom view of the transducer housing and trolling motor mount adapter shown in FIG. 14, in accordance with example embodiments described herein.

The trolling motor mount adapter 90 may be configured to receive the transducer housing 50 (shown in FIGS. 14 and 14A). As such, with reference to FIG. 13A, the trolling motor mount adapter 90 may comprise a hole 98. The hole 98 may comprise a perimeter 99 that has an area that is smaller than the bottom surface 59 of the transducer housing 50. For example, the width of the hole of the trolling motor mount adapter ($H_W$) may be less than the width of the bottom surface of the transducer housing ($BS_W$) (shown in FIG. 14A) such that at least a portion of the transducer housing 50 may fit into the trolling motor mount adapter without falling through the hole 98. As such, the perimeter 99 of the hole 98 may form an engagement surface for the transducer housing 50. Having direct access to the water for at least a portion of the transducer housing 50 through the hole 98 allows the transducer/crystal in the transducer housing 50 the ability to send out sound waves to perform the desired measurements (e.g., "sounding").

In some embodiments, the trolling motor mount adapter 90 may comprise an engagement surface configured to receive at least a portion of the transducer housing 90 to facilitate engagement therebetween. In the depicted embodiment of FIG. 14, the trolling motor mount adapter comprises a protrusion or tab 94 that forms a securing feature for a portion of the upper surface of the transducer housing 50 to secure into. As such, one end of the transducer housing 50 may be fit into the tab 94 and then the reminder of the transducer housing 50 may be rotated downward into place within the trolling motor mount adapter 90.

Once the transducer housing 50 has been engaged with the trolling motor mount adapter 90, the trolling motor mount adapter 90 may be fastened to the trolling motor (shown in FIG. 12A). In some embodiments, the trolling motor mount adapter 90 may comprise at least one slot 92 configured to receive a hose clamp or other mounting strap 82. As noted above, the strap 82 may then be tightened around a portion of the trolling motor 29 to secure the trolling motor mount adapter 90 and transducer housing 50 to the motor.

Securing the transducer housing 50 and trolling motor mount adapter 90 to the motor with the strap 82, however, may leave the transducer housing 50 not fully protected. For example, space may remain between the transducer housing 50 and the motor 29 allowing the transducer housing 50 to shift during movement, such as an impact with the bottom surface or an object in the water. As such, in some embodiments, a padding 97 (e.g., closed cell pad) may be positioned between the transducer housing 50 and the trolling motor 29 to at least partially protect and/or cushion the transducer and transducer housing 50.

As noted above, the close proximity of the bottom surface and objects in the water make maintaining a small form factor for mounting transducer housings to a trolling motor desirable. However, connecting a cable (e.g., cable 25) to the transducer may also be required. As such, in some embodiments, the trolling motor mount adapter 90 may comprise a notch or other feature 95 that enables the cable 25 to pass through the trolling motor mount adapter 90 without causing the transducer housing 50 and trolling motor mount adapter 90 to unnecessarily extend further below the trolling motor 29.

Figure 15:
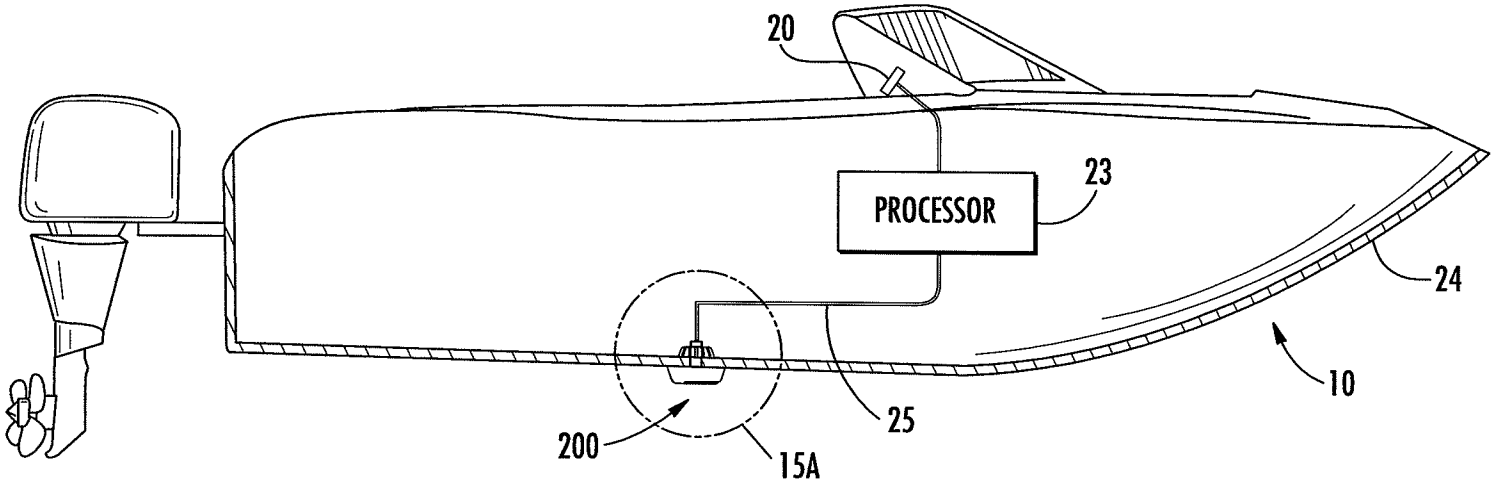
FIG. 15 illustrates a system for thru-hull mounting a transducer housing to a boat, in accordance with example embodiments described herein.

FIG. 15 illustrates an example system 200 for mounting a transducer through the hull of a boat 10. In the depicted embodiment, the transducer is mounted through the hull 24 of the boat 10. In some embodiments, as described above, a cable 25 may connect the transducer to a processor 23 and/or sonar head 20 having a display providing an indication (e.g., depth, fish location, etc.) to a user/driver.

Figure 15A:
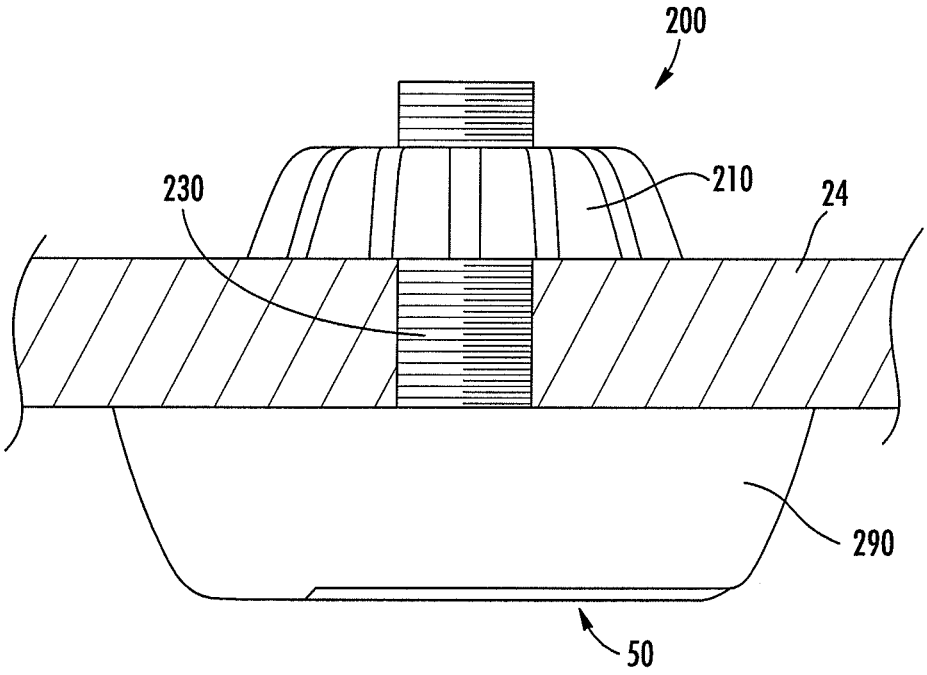
FIG. 15A shows a detail view of the system for thru-hull mounting a transducer housing to the boat shown in FIG. 15, in accordance with example embodiments described herein.

FIG. 15A represents a detailed view of the system 200 for mounting a transducer through the hull of a boat. In the depicted embodiment, a screw 230 passes through the hull 24. A nut 210 or other securing features may secure the screw 230 from inside the boat. Additionally, in some embodiments, sealing elements (e.g., washers) may be positioned around the screw 230 to prevent water from leaking through the screw hole in the hull of the boat. In the depicted embodiment, the transducer housing 50 is positioned inside a thru-hull mount adapter 290. In some embodiments, the thru-hull mount adapter 290 may comprise similar features to the previously described trolling motor mount adapter 90. As such, in some embodiments, the transducer housing 50 may be configured to adjacently engage the thru-hull mount adapter 290, such as with a lower engagement surface. Additionally, in some embodiments, similar to the trolling motor mount adapter, the thru-hull mount adapter 290 may comprise a hole for receiving at least a portion of the transducer housing 50 such that the transducer housing 50 may contact the water in order to transmit sound waves.

As described herein, embodiments of the present invention provide systems and apparatuses for interchangeable mounting options for a transducer housing. As such, example descriptions of certain mounting options contain a common transducer housing 50 that may be interchangeable between the described mounting options. While FIG. 16 illustrates one example method for changing a transducer housing from a transom mounting to a trolling motor mounting, other methods are contemplated for changing mounting options for the transducer housing between various combinations of the mounting systems described herein.

Figure 16:
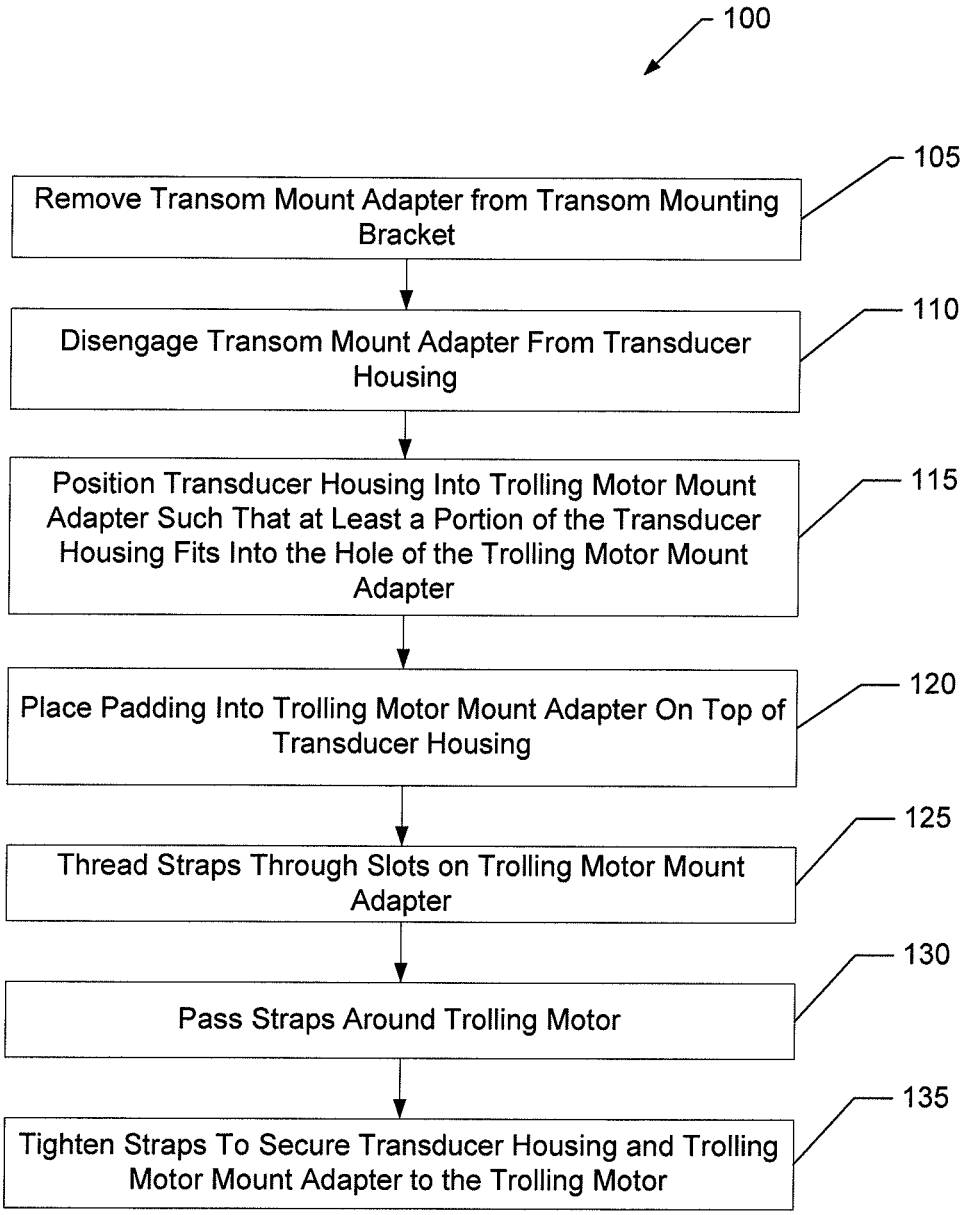
FIG. 16 illustrates an example method for changing mounting of a transducer housing from a transom mounting to a trolling motor mounting, in accordance with example embodiments described herein.

FIG. 16 illustrates a flow chart of an example method 100 of changing a transducer housing from a transom mounting to a trolling motor mounting. At operation 105, the transom mount adapter may be removed from the transom mounting bracket. Then, at operation 110, the transom mount adapter may be disengaged (e.g., slide off) from the transducer housing. The transducer housing may next be placed into the trolling motor mount adapter such that at least a portion of the bottom surface of the transducer housing fits into the hole of the trolling motor mount adapter at operation 115. Next, at operation 120, a padding may be placed into the trolling motor mount adapter on top of the transducer housing. Straps, or a hose clamp, may then be thread through the slots of the trolling motor mount adapter at operation 125. After that, at operation 130, the straps (or hose clamp) may be passed around the trolling motor. Finally, at operation 135, the straps (or hose clamp) may be tightened to effect securing and mounting of the transducer housing to the trolling motor.

Embodiments of the present invention provide a number of advantages. For example, systems and apparatuses are provided herein for interchangeable mounting options for a transducer housing. As such, a customer can simply purchase a kit for trolling motor mounting, portable mounting, or thru-hull mounting which attaches to the transducer included with the sonar. Moreover, in some embodiments, there is no compromise in performance over a transducer designed for a single mounting method. For example, the water resistance and turbulence caused by each mounting method is at least as small as with a transducer designed for a single mounting method. The added parts required add minimum cost and assembly for each mounting method. Additionally, assembly is no more complicated than what is required for a transducer designed for a single mounting method. In some embodiments, the transom mount adapter (and portable mount adapter) easily slides onto the transducer housing and snaps in place. Additionally, in some embodiments, no tools are required to attach the two parts to each other.

Many modifications and other embodiments of the inventions set forth herein will come to mind to one skilled in the art to which these embodiments pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A system for interchangeable mounting options of a sonar transducer to a watercraft, the system comprising:

at least one transducer;

a transducer housing configured to house the at least one transducer, wherein the transducer housing defines at least one upper engagement surface that is configured to adjacently engage at least two different types of mount adapters; and a first mount adapter to facilitate a first type of mounting, wherein the upper engagement surface is configured to adjacently engage the first mount adapter in a first instance to facilitate the first type of mounting, wherein the upper engagement surface is further configured to adjacently engage a second mount adapter in a second instance to facilitate a second type of mounting, wherein the first type of mounting is different than the second type of mounting, wherein the upper engagement surface is configured to slide into engagement with the first mount adapter to maintain the transducer housing in a fixed orientation with respect to the watercraft, wherein the upper engagement surface is configured to slide into engagement with the second mount adapter to maintain the transducer housing in a fixed orientation with respect to the watercraft, and wherein the at least one upper engagement surface is configured to releasably engage the first mount adapter to allow the first mount adapter to be detached and removed without damaging or altering the transducer housing, wherein the at least one upper engagement surface is configured to releasably engage the second mount adapter to allow the second mount adapter to be detached and removed without damaging or altering the transducer housing.

2. The system according to claim 1, wherein the upper engagement surface is configured to attach to the first mount adapter through a snap-fit engagement, wherein the upper engagement surface is configured to attach to the second mount adapter through a snap-fit engagement.

3. The system according to claim 1, wherein the upper engagement surface is configured to attach to the first mount adapter without fasteners, wherein the upper engagement surface is configured to attach to the second mount adapter without fasteners.

4. The system according to claim 1 further comprising a transom mounting bracket, wherein the first mount adapter is configured to attach to the transom mounting bracket, and wherein the transom mounting bracket is configured to attach to the transom of the boat.

5. The system according to claim 1 further comprising a thru-hull mounting bracket, wherein the second mount adapter is configured to attach to the thru-hull mounting bracket, and wherein the thru-hull mounting bracket is configured to mount through the hull of the boat.

6. The system according to claim 1, wherein the first mount adapter is configured to mount to a boat.

7. The system according to claim 1, wherein the first mount adapter is configured to mount to the hull of a boat.

8. The system according to claim 1, wherein the first mount adapter is configured to mount to the transom of a boat.

9. The system according to claim 1, wherein the transducer housing is configured to separably house the at least one transducer.

10. The system according to claim 1, wherein the at least one transducer comprises at least one of a cylindrical transducer, a rectangular transducer, or an elliptical transducer.

11. The system according to claim 1, wherein the at least one transducer comprises more than one transducer.

12. The system according to claim 11, wherein the transducers include transducers of at least two different shapes.

13. A transducer housing configured for interchangeable mounting options for a watercraft, wherein the transducer housing is configured to house at least one transducer; wherein the transducer housing comprises:

at least one upper engagement surface configured to adjacently engage at least two different types of mount adapters, wherein the at least one upper engagement surface is configured to adjacently engage a first mount adapter in a first instance to facilitate a first type of mounting, wherein the at least one upper engagement surface is further configured to adjacently engage a second mount adapter in a second instance to facilitate a second type of mounting, wherein the first type of mounting is different than the second type of mounting, wherein the at least one upper engagement surface of the transducer housing is configured to slide into engagement with the first mount adapter to maintain the transducer housing in a fixed orientation with respect to the watercraft, wherein the at least one upper engagement surface of the transducer housing is configured to slide into engagement with the second mount adapter to maintain the transducer housing in a fixed orientation with respect to the watercraft; and at least one lower engagement surface configured to adjacently engage a third mount adapter in a third instance to facilitate a third type of mounting, wherein the third type of mounting is different than the first type of mounting and the second type of mounting.

14. The transducer housing according to claim 13, wherein the first mount adapter comprises a transom mount adapter and the first type of mounting comprises mounting to a transom of a boat, and wherein the third mount adapter comprises a trolling motor mount adapter and the third type of mounting comprises mounting to a trolling motor.

15. The transducer housing according to claim 14, wherein the second mount adapter comprises a kayak mount adapter to facilitate mounting to a kayak or a portable mount adapter to facilitate portable mounting to the transom of the boat.

16. The transducer housing according to claim 13, wherein the transducer housing is configured to removably attach to the first mount adapter without fasteners, wherein the transducer housing is configured to removably attach to the second mount adapter without fasteners.

17. The transducer housing according to claim 16, wherein the transducer housing is configured to attach to the first mount adapter through snap-fit engagement.

18. The transducer housing according to claim 13, wherein the third mount adapter comprises a thru-hull mount adapter, and wherein the third type of mounting comprises a thru-hull mounting to a boat.

* * * * *